United States Patent [19]

Robertson et al.

[11] Patent Number: 5,015,106

[45] Date of Patent: May 14, 1991

[54] MARKING APPARATUS WITH MULTIPLE LINE CAPABILITY

[75] Inventors: John A. Robertson; David L. Cyphert, both of Chillicothe; Thomas E. Cyphert, Kingston; Joseph F. Muscarella, Columbus, all of Ohio

[73] Assignee: Telesis Controls Corporation, Chillicothe, Ohio

[21] Appl. No.: 411,726

[22] Filed: Sep. 25, 1989

[51] Int. Cl.[5] ..... B41J 2/22

[52] U.S. Cl. ..... 400/121; 400/127; 137/883

[58] Field of Search ..... 101/4, 35; 400/118, 400/127, 121; 137/883

[56] References Cited

U.S. PATENT DOCUMENTS

| | | | |
|---|---|---|---|
| 4,089,262 | 5/1978 | Sopora | 101/4 |
| 4,379,427 | 4/1983 | Middel et al. | 101/35 |
| 4,506,999 | 3/1985 | Robertson | 400/127 X |
| 4,591,279 | 5/1986 | Speicher | 400/127 X |
| 4,780,009 | 10/1988 | Crick | 400/127 X |
| 4,808,018 | 2/1989 | Robertson et al. | 400/127 X |

FOREIGN PATENT DOCUMENTS

| | | | |
|---|---|---|---|
| 2460134 | 7/1975 | Fed. Rep. of Germany | 101/4 |
| 3247577 | 7/1984 | Fed. Rep. of Germany | 101/4 |
| 3437171 | 4/1986 | Fed. Rep. of Germany | 101/4 |

*Primary Examiner*—Clifford D. Crowder

*Attorney, Agent, or Firm*—Mueller and Smith

[57] ABSTRACT

Apparatus for simultaneously forming one or more lines of multi-character messages on the surface of solid material which employs an array of marker pins which are moved by a carriage along a singular plane locus of movement defining a sequence of rows corresponding with a pixel matrix. The locus includes a retrace feature for each row or transverse movement which enhances the quality of character formation. An actuator assembly develops the locus of movement and, in turn, is driven by facing cam wheels which, in turn, are powered from an electric motor. A manifold which receives pneumatic pulses from arrays of conduits is coupled to the carriage and a marker head assembly, in turn, is removably coupled to the manifold. An array of solenoid actuated valves is coupled to the tubing arrays and to a pneumatic source which may be remotely positioned from the manifold.

31 Claims, 16 Drawing Sheets

FIG. 8
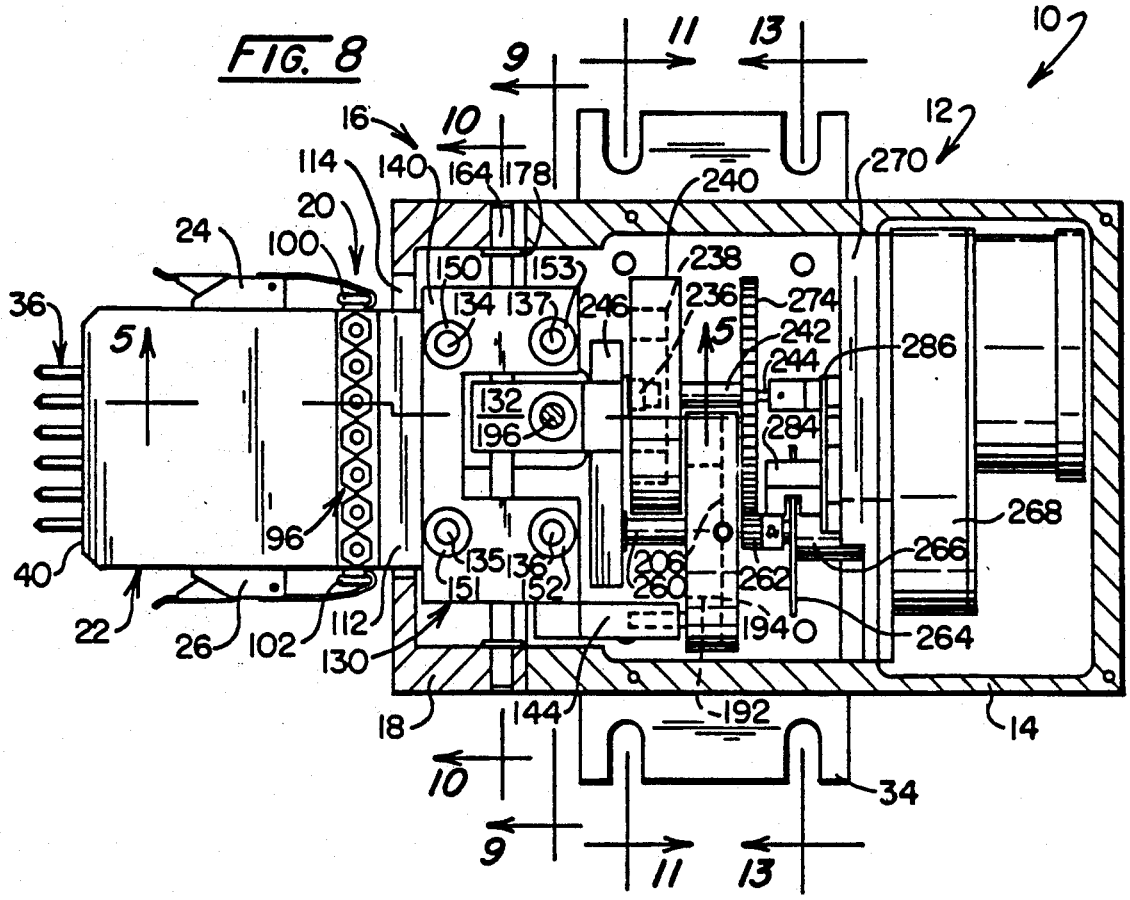
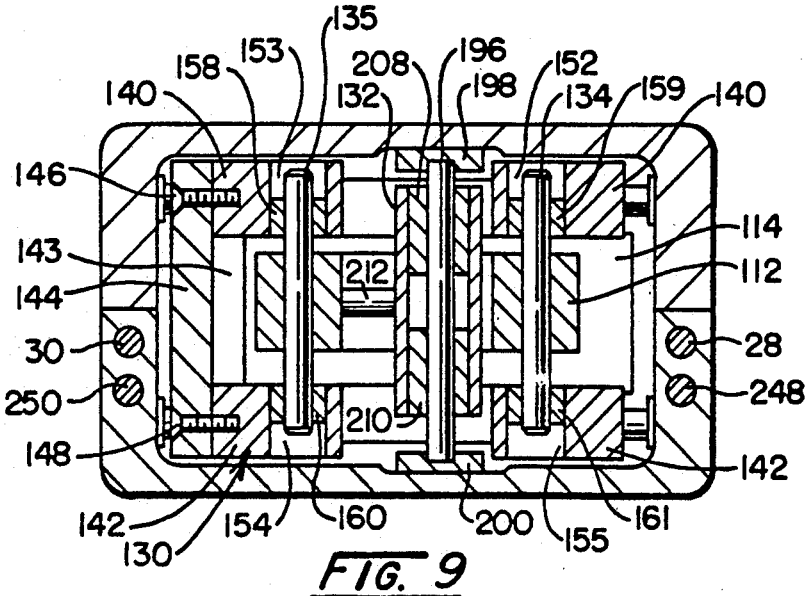
FIG. 9

+5V
374
372
376
S1
C1
378
370
BP RST
TD RST
TOL ST
GND
RST
SID
SOD
ALDA
READY
INTA
TRAP
INTR
HOLD
SO
SI
RD
WR
IOM
CLK OUT
RST OUT
RST 7.5
RST 6.5
RST 5.5
A15
A14
A13
A12
A11
A10
A9
A8
AD7
AD6
AD5
AD4
AD3
AD2
AD1
AD0
ALE
450
451
452
456
380
R9
414
R10
426
424
460
TO FIG.20B
508
FROM USART 474
436
416
422
410
420
532
510
538
540
530
446
S2
R2
390
PA7
PA6
PA5
PA4
PA3
PA2
PA1
PA0
430
R3
392
S3
PB7
PB6
PB5
PB4
PB3
PB2
PB1
412
434
RD
WR
IO/M
ALE
CE
RESET
418
514
566
574
601
600
599
598
597
596
560
561
569
610
618
625
624
623
622
621
620
619
612
604
632
359
352
BOTTOM ROW
TOP ROW
402
R6
PULSE
LOW AIR
R7
ABORT
404
406
PRINT
408
R8
389
TIMING DISK
366
R1
C2
384
386
388
TIMER IN
TIMER OUT
PC5
PC4
PC3
PC2
PC1
PC0
GND
438
440
444
442
432
DRIVE
FAULT
DONE
PRINTING
READY
630
Q
PR
D

FROM FIG. 20A
+5V
-24V
+24V
TXD
RXD
DTR
DSR
CTS
DCD
RX READY
TX READY
GND
BR/CLK
VCC
RESET
R/W
TXC
RXC
OSC OUT
OSC IN
DIS
OUT
WE
OE
CE
G1
G2A
G2B
C
B
A

MARKING APPARATUS WITH MULTIPLE LINE CAPABILITY

BACKGROUND OF THE INVENTION

As industry has continued to refine and improve production techniques and procedures, corresponding requirements have been observed for placing identifying or data related markings upon components of manufactured assemblies. With such marking, the history of a product may be traced throughout the stages of its manufacture.

A variety of product marking approaches have been employed in the industry. For example, paper tags or labels carrying bar codes or the like may be applied to components in the course of their assembly. However, for many applications, tags, labels, and the like will be lost or destroyed. Ink or paint spraying of codes such as dot matrix codes are employed for many manufacturing processes. However, where the production environment is too rigorous or subsequent painting steps are involved, such an approach will be found to be unacceptable.

The provision of a permanent or traceable marking upon hard surfaces such as metal or plastics traditionally has been provided with marking punches utilizing dies which carry a collection of fully-formed characters. These "full face dies" may be positioned in a wheel or ball form of die carrier which is manipulated to define a necessarily short message as it is dynamically struck into the material to be marked. As is apparent, the necessarily complex materials involved are prone to failure and full face dies exhibit rapid wear characteristics. Generally, the legibility and abrasion resistance of the resultant marks can be considered to be only fair in quality. Additionally, the marking punch approach is considered a poor performer in marking such surfaces as epoxy coatings and the like.

Laser activated marking systems have been employed, however, the required equipment is of relatively higher cost and the abrasion resistance and "readability after painting" characteristics of laser formed characters are considered somewhat poor.

In the recent past, a computer driven dot matrix marking technique has been successfully introduced into the marketplace. Described in U.S. Pat. No. 4,506,999 by Robertson entitled "Program Controlled Pin Matrix Embossing Apparatus", the marking approach employs a series of seven tool steel punches which are uniquely driven using a pneumatic floating impact concept to generate man-readable and/or machine readable dot codes. Marketed under the trade designation "PINSTAMP", these devices carry the noted tool steel punches or "pins" in a head assembly which is moved relative to the piece being marked in selected skew angles to indent a dot or pixel defining permanent message or code into a surface of the marked component. The approach enjoys the advantage of providing characters of good legibility as well as permanence. Further, a capability for forming the messages or codes during forward or reverse head movements is realized. The device provides dot matrix characters of good abrasion resistance, good permanence and legibility, and is, advantageously, capable of marking upon such surfaces as epoxy coatings. Use of this basic dot matrix character stamping device is limited, however, to piece parts which are both accessible and of adequate size.

Robertson, et al., in U.S. Pat. No. 4,808,018, issued Feb. 28, 1989, describes a dot matrix character impact marking apparatus which advantageously is capable of forming messages or arrays of characters within a very confined region. With this device, a linear array of marker pins is moved by a carriage in a manner defining an undulating locus of movement. This locus traces the matrix within which character fonts are formed by the marker pins. The carriage and head containing the marker pin are pivotally driven by a cam to provide vertical momement and by a Geneva mechanism to provide horizontal movement. Pixel positions for the matrices are established by a timing disk and control over the pins is provided by employing an interrupt approach. Each marking pin within the head assembly of this advantageously portable device is capable of marking more than one complete character for a given traverse of the head between its limits of movement.

The demonstrated success of the above-noted pivoting head pinstamping apparatus has lead to additional calls on the part of industry for smaller, lower weight and faster impact marking devices. Additionally, with the need to provide more data in conjunction with marking, a need has arisen to develop a technique for marking multiple lines of characters and providing for variable character size. In addition to a call for a device providing these advantages, a continuing need exists for developing a device which is of lower cost; employs fewer parts, and has an advantageously modular and easily altered and repaired structuring.

Further, with the development of smaller characters and multiple lines of such characters, it is important that the pixel formation or indentations developed by such devices be of consistently uniform and proper font design alignment. The latter criteria should be evolved without the expenditure of undue calibration time during the course of assembly of such devices.

SUMMARY

The present invention is addressed to an apparatus and method for marking surfaces of solid material objects. The apparatus retains a capability for forming strings of characters in dot matrix fashion within confined regions and does so with an advantageous, multiple line capability. This multiple line capability is achieved in conjunction with cost reducing improvements in the actuating mechanism of the apparatus. By employing a singular plane locus of movement of the marker head assembly of the device, multiple line capabilities are realized. This multiple line capability advantageously may be implemented in a broad variety of line configurations, for example in widely spaced positions, thus accommodating the apparatus to the marking of objects simultaneously at different positions. Further, by employing a retrace method in transverse or row defining movement of the head, improved dot matrix character definition is achieved.

The actuator assembly of the apparatus advantageously is simple in structure, while remaining capable of carrying out a requisite singular plane locus of movement. This assembly forms part of a generally modular design, having a rearwardly extending cam follower arrangement which operationally couples with the facing rotational cams of a cam assembly driven by an electric motor.

The desirably modular aspect of the apparatus also carries to its forwardly disposed structure. A carriage having an attachment portion and forming a component of the actuator assembly is driven along the requisite locus of movement for character string formation. To this carriage, a manifold is connected and the head assembly is connected to the manifold by hand actuated latches. Pneumatic inputs, including necessary valving and the like, are generated remotely of the manifold. With such an arrangement, field alteration of the marker head configuration, as well as on-site maintenance, readily are carried out by user personnel.

Another feature of the invention is the provision of apparatus for marking solid material objects at a surface thereof in response to data inputs with a sequence of indentation defined characters, each within a pixel matrix of rows and columns. This apparatus includes a housing and an actuator assembly mounted within the housing having a cam follower driven input and a translational mechanism including an attachment portion drivable along vertical and transverse directions from the driven input to define a substantially singular plane locus of movement of the attachment portion representing a sequence of parallel, spaced, row-defining movements between first and second row end terminal positions. The row defining movement spacing sequence occurs between first and second row sequence end positions. A marker head assembly is provided which is coupled with the attachment portion and has a confronting portion positionable in spaced adjacency with the surface to be marked and includes at least one marker pin having an impacting tip drivably movable into the surface in response a control signal. A cam assembly is mounted adjacent the actuator assembly for rotational driving association with the cam follow driven output and which is drivably rotatable to effect the translational mechanism drive. A motor having a drive output is provided for drivably rotating the cam assembly. A timing arrangement is incorporated for deriving pixel position signals corresponding with the pixels of the matrix and terminal signals corrresponding with the above-noted first and second row sequence end positions. A control arrangement is responsive to the data inputs, the pixel position signals and the terminal signals for deriving the control signals.

Another feature of the invention provides apparatus for marking solid material objects at a surface thereof in response to data inputs with two lines of sequences of indentation defined characters each within a pixel matrix of rows and columns. The apparatus includes a housing and an actuator assembly mounted within the housing. The actuator assembly has a driven input and a translation mechanism including a carriage drivable along vertical and transverse directions from the driven input to define a substantially singular plane locus of movement representing a sequence of parallel, spaced, row defining movement along the transverse direction between first and second row end terminal positions. The row defining movement spacing sequence occurs along the vertical direction between first and second row sequence terminal positions. A manifold is connectable with the carriage and has first and second arrays of input ports for receiving pneumatic drive pulses and first and second arrays of corresponding output ports in respective pneumatic communication therewith for conveying the drive pulses. A marker head is connectable with the manifold and has a confronting portion positionable in spaced adjacency with the surface to be marked and has first and second linear and parallel arrays of chambers extending interiorly from corresponding respective openings at the confronting portion and in respective and corresponding pneumatic communication with the manifold first and second arrays of output ports. Each chamber has a marker pin mounted for reciprocation therein and each marker pin has a drive portion and a shaft portion depending therefrom and extending to an impacting tip and which is selectively drivably extensible through an opening of the chamber in response to a conveyed pneumatic drive pulse. A pneumatic drive assembly is coupled with the manifold first and second arrays of input ports and is responsive to control signals for deriving the pneumatic drive pulses, while a drive arrangement is provided for effecting drive of the actuator assembly driven input. A timing arrangement is responsive to the drive arrangement for deriving pixel position signals corresponding with the pixels of the matrix and for deriving terminal signals corresponding with the first and second row sequence end positions. A control is responsive to the data inputs, the pixel position signals and the terminal signals for deriving the control signals effecting simultaneous formation of the two lines of indentation defined characters.

Another feature of the invention provides a method for marking solid material objects at a surface thereof in response to data inputs with two, spaced-apart lines of sequences of indentation defined characters, each within a pixel matrix of rows and columns comprising the steps of:

providing a housing;

providing an actuator assembly mounted with the housing and actuable to move along a locus of movement;

providing a marker head assembly connected with the actuator assembly, having a confronting portion and including two linear arrays of marker pins, the arrays of marker pins being spaced apart in correspondence with the two spaced apart lines, each marker pin having an impacting tip extensible from the confronting portion when actuated to form an indentation in the surface;

positioning the confronting portion in spaced adjacency with the surface;

actuating the actuator assembly to effect movement of the marker head assembly along the locus of movement wherein the confronting portion is located in a single plane substantially parallel with its surface, the movement being a sequence of parallel transverse movements between first and second row end terminal positions corresponding with each successive row of the matrix and a sequence of movements extending between first and second row sequence end positions transitioning between successive adjacent rows while retracing from the second to the first row in terminal position;

actuating the marker pins in response to the data inputs in correspondence with the matrix columns only during the head assembly movement from the first to the second row end terminal position such that each marker pin, when actuated, forms at least one character of one line.

Another feature of the invention is the provision of apparatus for marking solid material objects at a surface thereof in response to data inputs with a sequence of indentation defined characters, each within a pixel matrix of rows and columns. The apparatus comprises a housing and an actuator assembly mounted within the housing having a translational mechanism including an attachment portion drivable along vertical and transverse directions to define a substantially singular plane locus of movement of the attachment portion representing a sequence of parallel, spaced, row defining movements, each row defining movement occurring between first and second row end terminal positions, each row defining movement being followed by a retrace movement to a next adjacent first row end terminal position, the sequence of spaced, row defining movements occurring between first and second row sequence terminal positions. A marker head assembly is provided which is coupled with the attachment portion, having a confronting portion positionable in spaced adjacency with the surface to be marked and including at least one marker pin having an impacting tip drivably movable into the surface in response to control signals. A drive arrangement is provided for effecting the drive of the translational mechanism and a timing arrangement is provided for deriving pixel position signals corresponding with the pixels of the matrix columns only during the actuator assembly movement of the attachment portion from the first to the second row end terminal positions. A control arrangement is responsive to the data input for deriving the control signals.

Another feature of the invention provides apparatus for marking solid material objects at a surface thereof in response to data inputs with a sequence of indentation defining characters, each within a pixel matrix of rows and columns. The apparatus includes a housing and a pneumatic distributor mounted with the housing and having an array of input ports for receiving pneumatic drive pulses and first and second arrays of corresponding output ports in respective pneumatic communication therewith for conveying the drive pulses. A marker head is connectible with the pneumatic distributor and has a confronting portion positionable in spaced adjacency with the surface and having an array of chambers extending interiorly from corresponding respective openings at the confronting portion and in respective and corresponding pneumatic communication with the pneumatic distributor array of output ports, each chamber having a marker pin mounted for reciprocation therein, each marker pin having a drive portion and a shaft portion depending therefrom extending to an impacting tip and selectively drivably extensible through the opening of the chamber in response to a conveyed pneumatic drive pulse. A pneumatic drive assembly is coupled with the pneumatic distributor array of input ports and has a plurality of adjacently disposed electromagnetically actuated, each valve having an intake port and an output port for selective passage of the pneumatic drive pulses into the pneumatic distributor input ports, and a pneumatic chamber connectible with a supply of air under pressure in common pneumatic communication with each intake port of the valves. The pneumatic chamber has a volumetric size selected as effective to substantially eliminate degradation of performance of one marker pin when that pin is substantially simultaneously driven with another marker pin. A control arrangement is responsive to the data inputs for actuating the valves to effect formation of the indentation defined characters.

As another feature, the invention provides a method for marking solid material objects at a surface thereof in response to data inputs with a sequence of indentation defined characters, each within a pixel matrix of rows and columns, comprising the steps of:

providing a housing providing an actuator assembly mounted within the housing and actuable to move along a locus of movement;

providing a marker head assembly connected with the actuator assembly, having a confronting portion and including a linear array of marker pins, each marker pin having an impacting tip extensible from the confronting portion when actuated to form the indentations in the surface;

positioning the confronting portion spaced adjacency with the surface;

actuating the actuator assembly to effect movement of the marker head assembly along a locus of movement wherein the confronting portion is located in a single plain substantially paralell with the surface, the movement being a sequence of parallel transverse movements between first and second row end terminal positions corresponding with each successive row of the matrix and a sequence of movements extending between first and second row sequence terminal positions transitioning between successive adjacent rows while retracing from the second to the first row end terminal positions; and actuating the marker pins in response to the data inputs in correspondence with the matrix columns only during the head assembly movement from the first to the second row end terminal positions such that each marker pin, when actuated, forms at least one character.

Another feature of the invention provides apparatus for marking solid material objects at surface portions thereof in response to data inputs with two lines of sequences of indentation defined characters, each within a pixel matrix of rows and columns. The apparatus includes a housing and an actuator assembly mounted within the housing. The actuator assembly has a driven input and a translation mechanism including a carriage drivable along vertical and transverse directions from the driven input to define a substantially singular plane locus of movement representing a sequence of parallel, spaced, row-defining movements along the transverse direction between first and second row end terminal positions. The row defining movement spacing sequence occurs along the vertical direction between first and second row sequence terminal positions. A manifold is connectible with the carriage and has first and second spaced apart arrays of input ports for receiving pneumatic drive pulses and first and second spaced apart arrays of corresponding output ports in respective pneumatic communication therewith for conveying the drive pulses. A first marker head is connectible with the manifold and has a first confronting portion positionable in spaced adjacency with a first surface portion and has a first parallel array of chambers extending interiorly from corresponding openings at the first confronting portion and in corresponding pneumatic communication with the manifold first array of output ports. Each chamber of the first array thereof has a marker pin mounted for reciprocation therein and each of such marker pins has a drive portion and a shaft portion depending therefrom extending to an impact tip selectively drivably drivably extensible through the opening of the chamber in response to a conveyed pneumatic drive pulse. A second marker head is provided which is connectible with the manifold and has a second confronting portion positionable in spaced adjacency with a second surface portion and has a second linear and parallel array of chambers extending interiorly from corresponding openings at the second confronting portion and in corresponding pneumatic communication with the manifold second array of output ports. Each chamber of the second array thereof has a marker pin mounted for reciprocation therein, each such marker pin having a drive portion and a shaft portion depending therefrom extending to an impacting tip and selectively drivably extensible through an opening of the chamber in response to a conveyed pneumatic drive pulse. A pneumatic drive assembly is coupled with the manifold first and second arrays of input ports and is responsive to control signals for deriving the pneumatic drive pulses. A drive arrangement is provided for effecting drive of the actuator assembly driven input and a timing arrangement is provided which is responsive to the drive arrangement for deriving pixel position signals corresponding with the pixels of the matrix.

Other features of the invention will, in part, be obvious and will, part, appear hereinafter. The invention, accordingly, comprises the apparatus and method providing the construction, combination of elements, arrangement of parts, and steps which are exemplified in the following detailed disclosure. For a fuller understanding of the nature and objects of the invention, reference should be had to the following detailed description taken in connection with the accompanying drawings.

BRIEF DESCRIPTION OF THE DRAWINGS

FIG. 8 is a sectional view taken through the plane 8—8 shown in FIG. 2;

FIG. 9 is a sectional view taken through the plane 9—9 represented in FIG. 8;

DETAILED DESCRIPTION OF THE INVENTION

Figure 1:
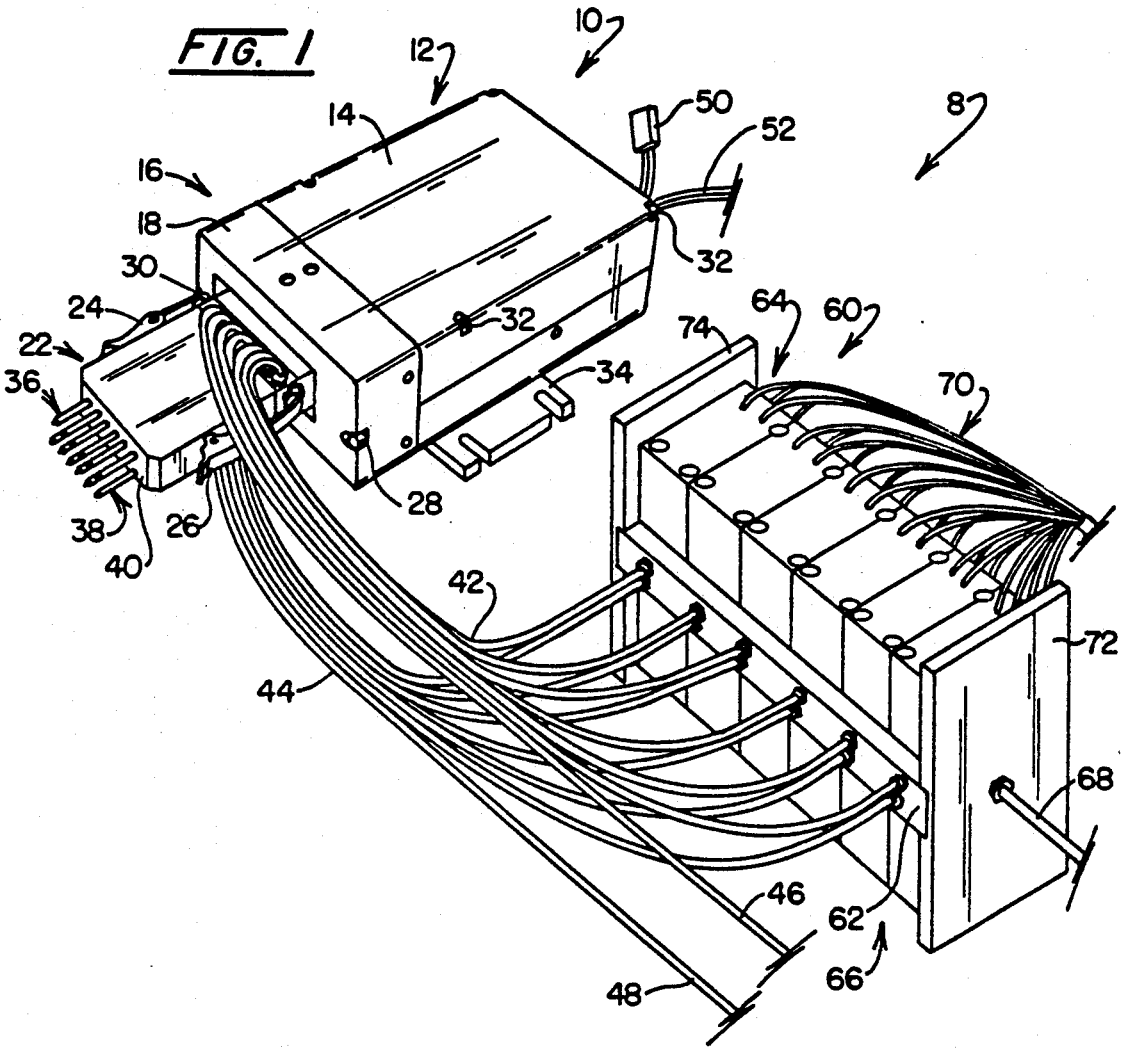
FIG. 1 is a perspective view of apparatus according to the invention.

The marking apparatus of the instant invention enjoys a broad and versatile range of marking applications. It is desirably modular in its structure and retains the capability for easily carried out field modifications and maintenance. Referring to FIG. 1, the overall apparatus or system is represented generally at 8, this system 8 includes an apparatus represented generally at 10, which includes a rearwardly disposed rotational cam drive represented generally at 12 as enclosed within a housing 14, a forwardly disposed actuator assembly represented generally at 16 positioned within a housing 18, a marker head assembly shown generally at 19 which includes a markerhead manifold or pneumatic distributor 20, a marker head represented generally at 22, and a pneumatic drive assembly represented generally at 60. Head 22 is retained in position upon the manifold 20 by oppositely disposed draw latches 24 and 26, while the actuator housing 18 is retained in position against the front face of housing 14 by two oppositely disposed socket head cap screws 28 and 30. Similar forms of screws as at 32 retain the two halves of housing 14 together. A bracket as at 34 provided for attachment of the device to a jig or the like is shown coupled to the lowermost portion of housing 14. Marker head 22 is shown having two linear and parallel arrays of marking pins 36 and 38 extending from a confronting portion or surface 40 thereof. The number of such pins may be varied to suit the needs of the user, six being shown in each of the arrays 36 and 38 in selectively spaced adjacency.

Figure 2:
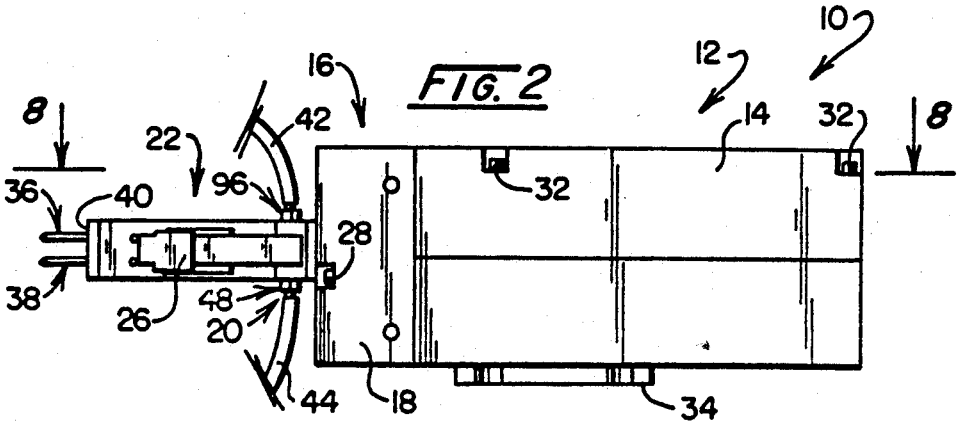
FIG. 2 is a side view of one component of the apparatus depicted in FIG. 1.
Figure 3:
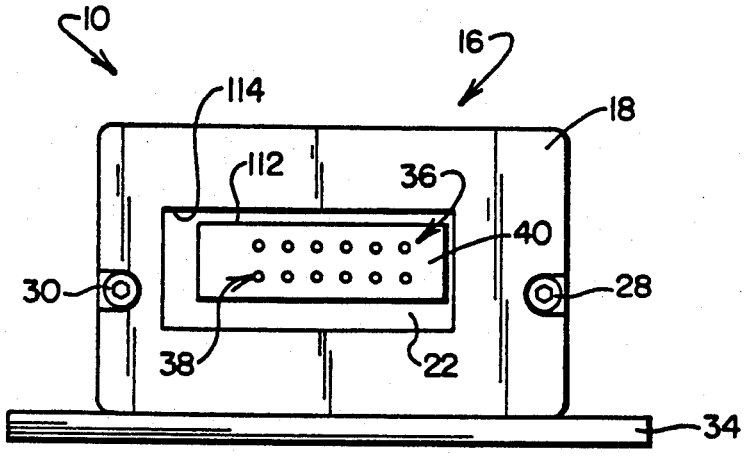
FIG. 3 is a front view of one component of the apparatus shown in FIG. 1.

Looking additionally to FIGS. 2 and 3, the marker head manifold 20 of assembly 19 is seen to be coupled along its upwardly disposed surface with an array 42 of pneumatic tubes or conduits and similarly, an array 44 of such tubes or conduits is coupled to its lowermost surface. These tubes carry pneumatically derived pulses for driving each of the pins within arrays 36 and 38 and, additionally, provide a pin return gas pressure along respective tubes or conduits 46 and 48. Arrays 42 and 44 present pneumatic control inputs to the apparatus, while electrical power and control is supplied thereto as represented by electrical lead assemblies 50 and 52.

The pneumatic pulse actuating input conduits of arrays 42 and 44 are seen being directed to remotely located pneumatic drive assembly 60. Assembly 60 is modular in its design, including a drive assembly manifold 62, the outputs of which are coupled to the pneumatic pulse conveying flexible tubes at arrays 42 and 44, as well as arrays of electromagnetically actuated or solenoid-driven valve assemblies represented generally at 64 and 66. The drive assembly manifold 62 is supplied marker pin driving gas or air under pressure via conduit 68 and the arrays of solenoid actuated valves 64 and 66 are powered and controlled from lead array 70. This entire modular assemblage is retained together, for example, by end plates as at 72 and 74.

While the pneumatic drive assembly 60 can be coupled with the marking apparatus 10, there are advantages to the option of locating it reasonably remotely from the marker head 22. In particular, the head 22 can be fabricated in smaller size permitting its use in a broader variety of applications because of its easier accessibility to otherwise difficult to access manufactured parts. In this regard, spaced separate marker heads may be utilized with the system which are mounted upon a single device 10. Also, the number of valve components may be altered with considerable ease to accommodate for variations in the structuring and design of the head 22.

Figure 4:
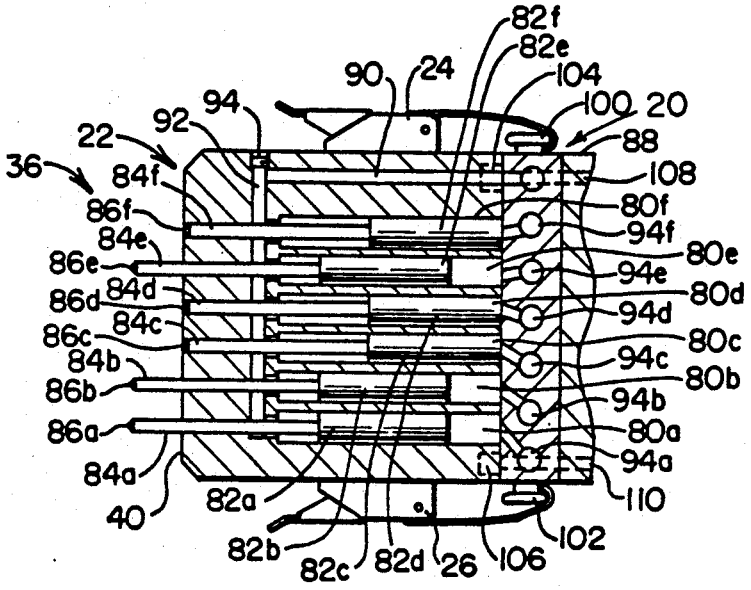
FIG. 4 is a sectional view taken through the plane 4—4 in FIG. 5.
Figure 5:
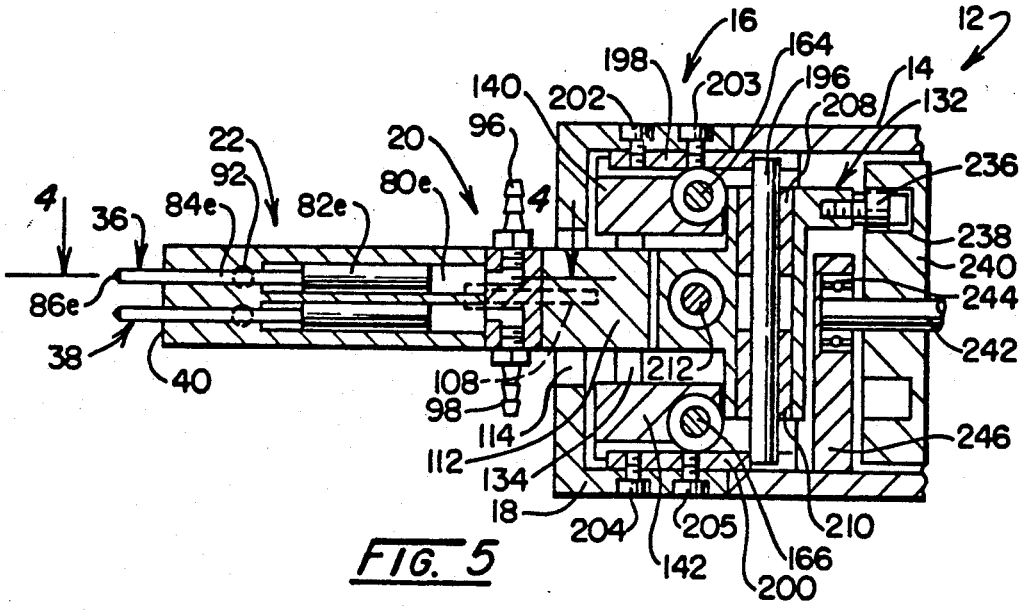
FIG. 5 is a partial sectional view taken through the plane 5—5 in FIG. 8.

Referring to FIGS. 4 and 5, cross-sectional representations of the marker head manifold 20 and marker head 22 are revealed. Marker head 22 is seen to retain the array 36 of marker pins within parallel and spaced cylindrical chambers 80*a*–80*f*, each of which slideably retains a marker pin respectively having drive portions 82*a*–82*f* and shaft portions 84*a*–84*f*. These shaft portions are seen to extend through bores of lesser diameter within head 22 and are reciprocally slideable within the chambers 80*a*–80*f* so as to be selectively driven to extend from the confronting portion or surface 40. In this regard, marker pins 84*a*, 84*b*, and 84*e* are seen extending from surface 40 in a marking orientation, while the shaft portions of pins 84*c*, 84*d*, and 84*f* are shown in a retracted orientation. Each of the shaft portions 84*a*–84*f* terminates in a conically shaped impacting tip shown, respectively, at 86*a*–86*f*.

Each of the pins of the array 36 are retained in their fully retracted positions by a return air or gas pressure exerted from conduit 46 (FIG. 1) which is in fluid communication with the marker head manifold 20 at port 88 thereof. Port 88 of the manifold 20 is seen to communicate with gas conduits 90 and 92 such that this return pressure is exerted against the forwardly-facing surface of each of the marker pin drive portions 82*a*–82*f*. Conduit 92 is seen to be closed by a threaded plug 94. An identical structuring is provided for marker pin array 38 and associated chambers within the head structure 22. Pulse pneumatic drive input to each of the chambers 80*a*–80*f* is provided from conduit array 42 into manifold 20 ports 94*a*–94*f* which lead to the opposite side of respective drive portions 82*a*–82*f* of the marker pins. Each of the ports 94*a*–94*f* is configured to receive a pneumatic connector, one of an array of six of which is seen at 96 is FIG. 5. FIG. 5 also reveals the identical structuring for each of the marker pins of array 38, one pneumatic connector 98 of an array of six thereof being revealed therein. A vertical spacing of these two arrays 36 and 38 also is revealed in the latter figure. This spacing may be provided both in a singular marker head structure as shown, or provided in two separate and spaced marker heads or cartridges performing in conjuctions with two spaced manifold inputs as are described in conjunction with FIGS. 2A and 2B. A detailed description of the operation and designs for the marker pin structure is provided in the above referenced U.S. Pat. Nos. 4,506,999 and 4,808,018 which are incorporated herein by reference.

Marker head 22 may be designed having a variety of configurations and as noted, multiple heads may be utilized which are spaced apart for simultaneously marking at two spaced apart lines or locations on a piecepart. FIG. 4 shows the single head 24 being coupled to the marker head manifold 20 by two outwardly depending engaging heads or keepers 100 and 102 which are engaged by respective draw latches 24 and 26. To assure alignment of the rear surface of the head against the port outlets of manifold 20, two cylindrical recesses 104 and 106 are bored therein which slidably engage the respective heads of socket head cap screws 108 and 110 to achieve appropriate alignment. Cap screws 108 and 110, additionally serve to retain the manifold 20 in connection with the attachment portion of a carriage component 112 of the actuator assembly 16. Thus configured, the head 22 readily is installed and removed from the apparatus 10 for purposes of configuration change, marking pin replacement maintenance and the like. Carriage 112 functions to maneuver the combined head manifold 20 and marking head 22 along a predetermined singular plane locus which serves to establish the pixel matrix within which identation character structures are developed. Thus, the carriage 112 is seen to extend through a rectangular opening 114 located within the forwardly disposed surface of housing 18 as revealed in FIGS. 3 and 5.

Figure 2A:
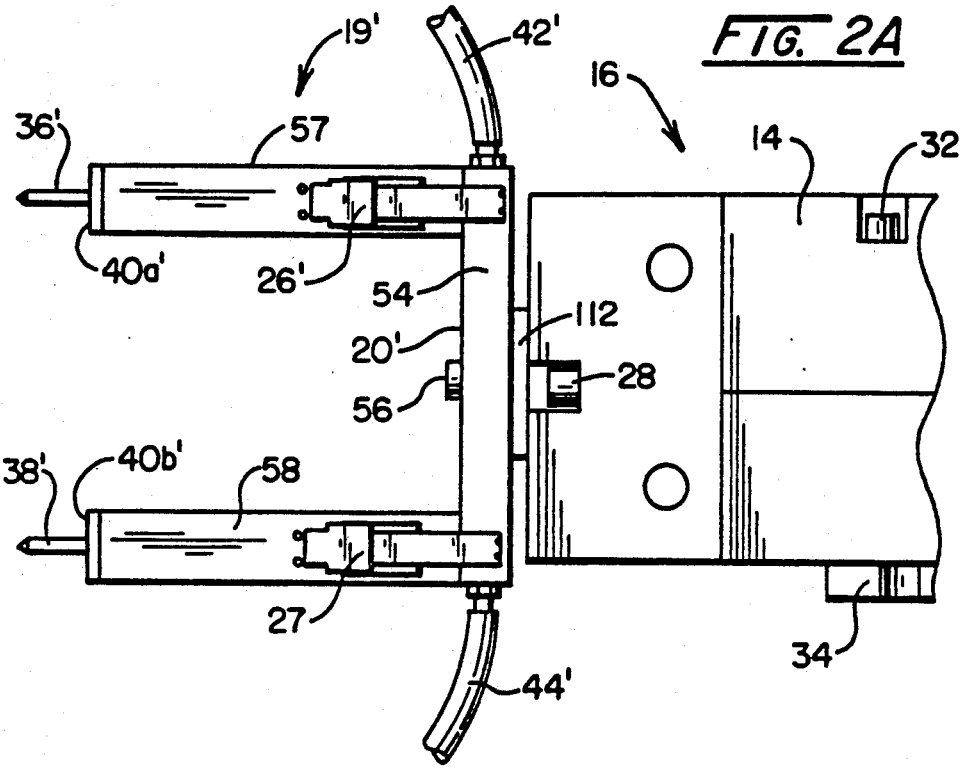
FIG. 2A is a side view of a spaced, dual head cartridge implementation of the component represented in FIG. 2.
Figure 2B:
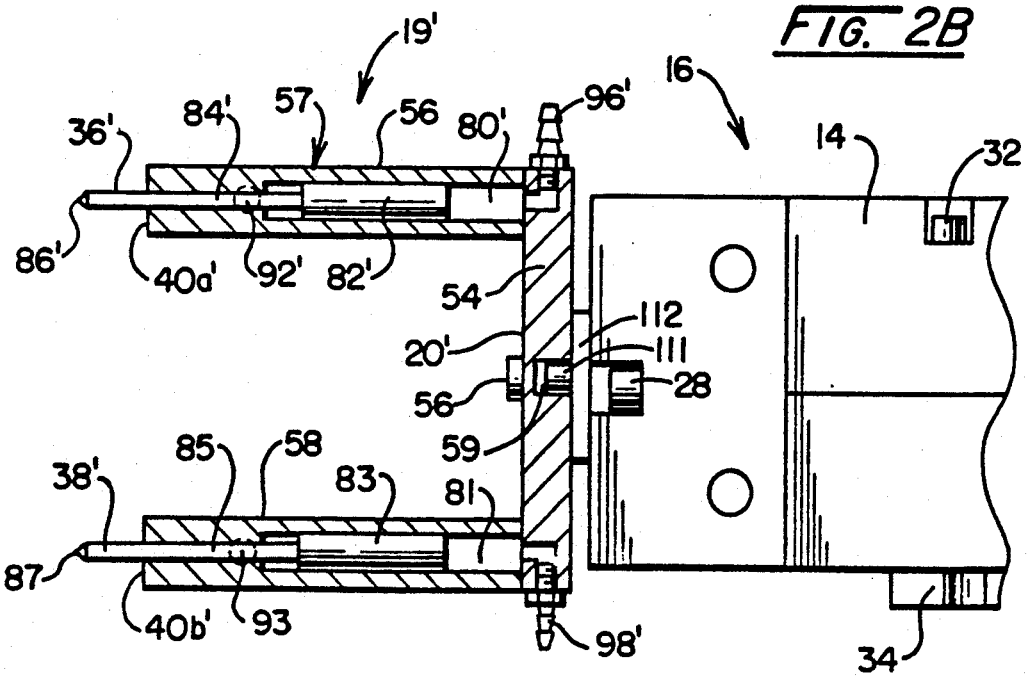
FIG. 2B is a partial sectional view of the cartridges and manifold portions of the component of FIG. 2A.

Referring to FIG. 2A, component 14 and its associated carriage 112 again is represented with the same numeration as above. However, in the embodiment of this figure, the carriage 112 supports a structure wherein the two linear arrays of marker pins described above at 36 and 38 are each located within a uniquely positioned head component or cartridge as represented at 57 and 58. These marker head assemblies or cartridges each carry an array of marking pins as earlier described at 36 and 38. In the interest of clarity, where identical structuring is involved, the numeration of the earlier-described figures is retained in primed fashion and, where appropriate, with alphabetical suffixes. FIG. 2A shows that head assembly 57 carries an array of marker head pins 36' extending from a confronting surface 40*a*'. Similarly, head assembly or cartridge 58 supports an array of marker head pins 38' extending from a confronting surface 40*b*'. Cartridges 57 and 58 are removably attached to a manifold 54 of expanded extent to permit the wide separation between heads 57 and 58 depicted. Head or cartridge 57 is seen to be coupled along its upwardly disposed surface with an array 42' of pneumatic tubes or conduits and similarly, an array 44' of such tubes or conduits is coupled at the outwardly disposed surface of head or cartridge 58. These arrays extend to the remotely located pneumatic drive assembly 60 in the manner represented in FIG. 1. The center portion of manifold 54 is attached to carriage 112 of the assembly 14 by a machine screw 56 and is aligned, as before, by recesses which are positioned over the heads of screws 108 and 110 (FIG. 4). Looking additionally to FIG. 2B, a sectional representation is provided of the spaced head cartridge embodiment at hand. In this regard, it may be observed that the head component or cartridge 57 supports an array of marker pins within a corresponding array of parallel and spaced cylindrical chambers, one of which is represented at 80'. Within each of these chambers is positioned a marker pin drive portion as represented at 82' from which extends shaft portions, one of which is represented at 84'. Shaft portions as at 84' extend to an impacting tip as represented at 86'. The manifold 54 input to the marker head cartridge 57 is seen configured to receive pneumatic connectors, one of which is revealed at 96' and which is in pneumatic communication with chamber 80'. Head cartridge 58 is structured in identical fashion as cartridge 57. In the latter regard, the head cartridge 58 is configured having an array of parallel spaced cylindrical chambers, one of which is revealed at 81, each of which contains a marker pin having a drive portion 83 which extends to a shaft portion 85, in turn terminating in an impacting tip 87. In similar fashion as the embodiment of FIGS. 4 and 5, a return air duct as at 92' is provided communicating with the forward facing end of chamber 80' and a similar duct represented at 93 within head cartridge 58 communicates with each of the chambers 81 for effecting pin return. Manifold 54 is configured in the case of head cartridge 58, in the same manner as cartridge 57. In this regard, an array of pneumatic connectors is provided, one of which is represented at 98'. Each of the latter connectors is in pneumatic communication with a corresponding chamber as at 81. One alignment cap screw 110 extending from the carriage 112 is seen mated within a corresponding recess 59 within manifold 54 for purposes of maintaining appropriate alignment of manifold 54.

The geometry of multiple head cartridges as described above may be varied to suit any particular industrial requirement. Thus, simultaneous marking of different lines of characters may be provided at different locations of varying depth from the device 14 on a particular object to be marked. The arrangement permits multiple marking within conveniently reduced time intervals and at lessened production cost.

Figure 6:
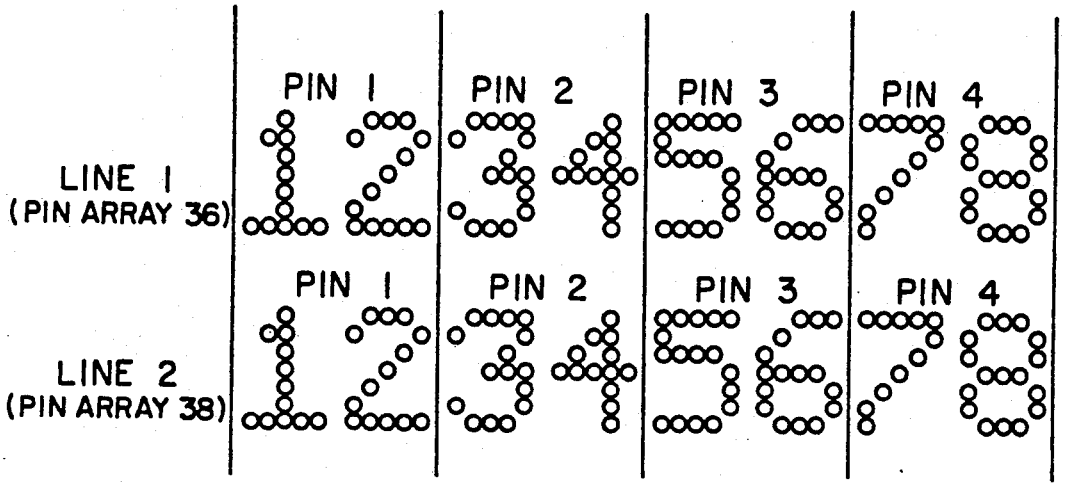
FIG. 6 is a diagrammatic representation of pixel defined characters created with two arrays of four marker pins in accordance with the invention.

In the course of movement of the carriage 112, the marking pins within linear pin arrays 36 and 38 are selectively actuated as the carriage moves in a row defining or transverse directional fashion from one row end terminal position to an opposite one. As this occurs, select marker pins are driven into the surface to be marked to commence formation of characters in dot matrix fashion. Multiple rows or arrays of marker pins may be actuated with the instant apparatus such that multiple lines of character sequences may be simultaneously formed. FIG. 6 reveals two such lines, for example, as may be developed by pin arrays 36 and 38 with respect to four adjacent marker pins in each array. For the representation shown, each of the four pins is called upon to form two characters during the course of movement of the carriage 112 and, consequently, head 22 along its assigned locus. The type of movement which is utilized for this locus definition for apparatus 10 is one in which, not only are the rows traversed essentially horizontally, but also there is a form of "retrace" movement in which each row of the matrix is started from the same row end terminal position. Looking additionally to FIG. 7, this form of locus of movement of a pin within an array such as 36 and 38 is diagramed. For the design illustrated, two characters are formed requiring a designation, for example, of 11 columns for a 5×7 pixel matrix of rows and columns. The approach as described permits marking from the bottom of the matrix toward the top or vice versa. Looking, initially to a procedure marking from the top to the bottom, for example, pin 2 (FIG. 6), will commence at point A as represented by the locus line 120. The pin is moved essentially horizontally or transversely to position B, whereupon the mechanism will cause a retrace to position C and during that retrace, a row transition to the next adjacent row occurs such that the next locus of movement is between row end terminal positions C and D. This procedure continues until the seventh row is completed as represented between row end terminal positions E and F. Thus, the row-defining movement spacing sequence occurs between row sequence terminal positions A and F.

Figure 7:
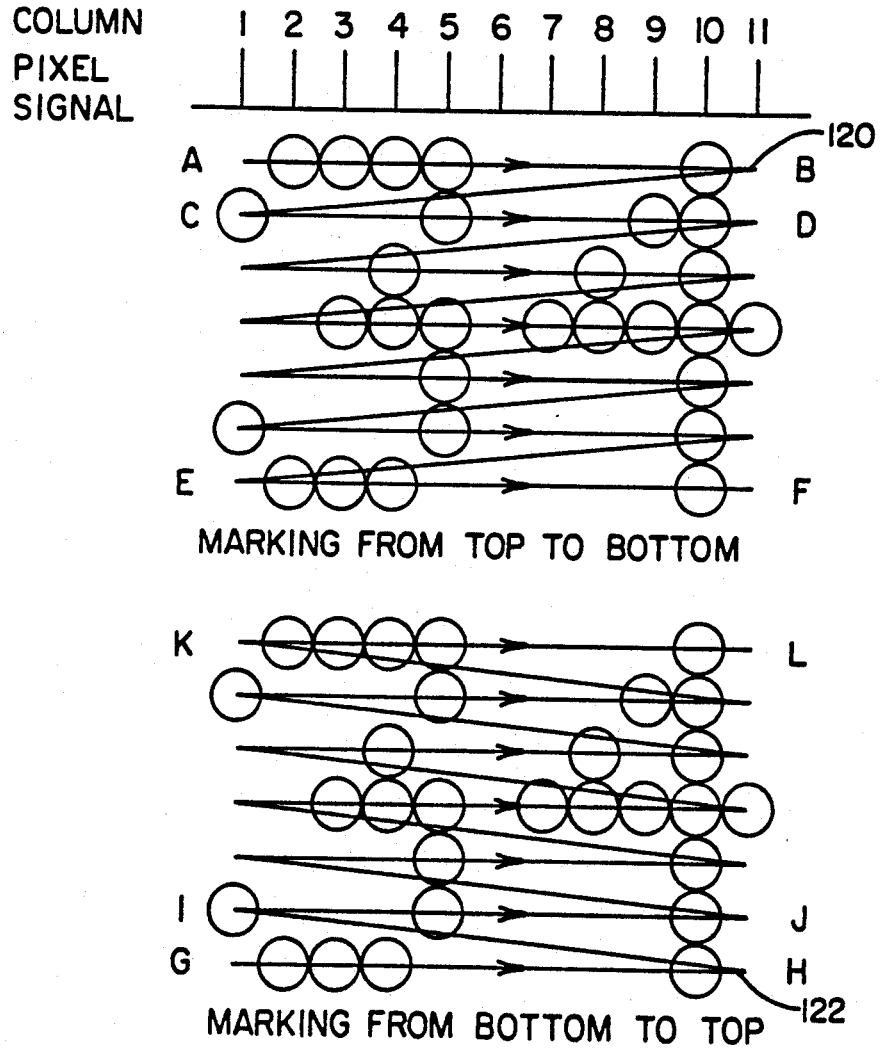
FIG. 7 is a diagrammatic representation of characters formed with the apparatus of the invention showing loci of single plane movement of a marker pin head and associated driving carriage.

It is not necessary for the mechanism to return to the row sequence terminal position A, prior to forming a next sequence of data or message lines. In this regard, the locus 122 in FIG. 7 shows a marking from the bottom toward the top row sequence terminal positions. In this regard, following the reaching of terminal position F for locus 120, a retrace is carried out to row sequence terminal position G, whereupon marking occurs to row end terminal position H, whereupon a retrace action occurs as the marker pin of the array of pins is moved to the next row end terminal position, for the instant example shown at I. The locus then continues to row end terminal position J and this process is repeated for seven rows to the row end terminal position K and thence to row sequence terminal position L. A subsequent retrace will bring the marker pin array to an orientation for marking in the sequence of locus 120. It may be observed in FIG. 7 that column position 6 is one designated for spacing between characters. To achieve the multiple line character formation, for example, as shown in FIG. 6 at line 1 and line 2, carriage 112 and the coupled head components as at 22 are driven to define a substantially singular plane locus of movement for loci as at 120 and 122. The retrace activity represented by loci 120 and 122 is employed for the purpose of improving the quality of character definition. In this regard, a row is always started at the same position which, in turn, assures that the horizontal alignment and vertical alignment of components of the characters are in appropriately readable registry, notwithstanding lost motion and tolerance forms of inaccuracies which necessarily are present in involved translational motion mechanisms.

The actuator assembly 16 includes a cam follower driven input and a translational mechanism which is principally comprised of three components: the earlier-described carriage 112, a dual component carrier represented in general at 130 and an isolator component represented in general at 132, the latter two components being revealed, inter alia, at FIG. 8. Looking to FIG. 8, the carriage 112, which must be drivably movable along the loci described at 120 and 122 in conjunction with FIG. 7, is seen to be simply mounted upon four rods or shafts 134–137 to carrier 130 as seen in FIG. 8. Looking additionally to FIG. 9, the technique by which carriage 112 is mounted to these rods 134–137 is revealed. In the figure, the generally U-shaped carriage 112 is seen fixed to rods 134 and 135 at about their center location. Carrier 130 is seen to be formed of two U-shaped components 140 and 142 which are spaced apart to define a transverse access region 143 and are fastened together by a rearwardly-extending link 144 with machine screws as at 146 and 148. While two components 140 and 142 are depicted which are mechanically joined, the carrier can also be made in unitary fashion, the two components being integrally formed as portions with link 144. The U-shape of carrier components 140 and 142 also provides a vertical access region 145 within which the isolator component 132 is located. To slidably receive rods 134–137, respective bores 150–153 are made in component 140 of carrier 130 as seen in FIG. 8 and a corresponding four bores are formed in component 142 of the carrier 130, two being shown in FIG. 9 at 154 and 155. Within each of the above bores in the carrier 130 mounted with an anaerobic adhesive marketed, for example, by Loctite Corp. of Cleveland, Ohio, there is a slidable retainer such as a fabric composite bearing represented at 158–161 in FIG. 9. These bearings may be provided, for example, as those marketed under the trade designation "Duralon" by Rexnord, Inc., Downers Grove, Ill. With the arrangement shown, the carriage 112 may be driven in what may be termed a Y-axis or "vertical" direction within the carrier 130, the rods 134–137 being dimensioned such that during such travel they will not extend outwardly from the bores within components 140 and 142 into which they extend. the term "vertical" is used herein in the general sense of a column direction for character formation.

Figure 10:
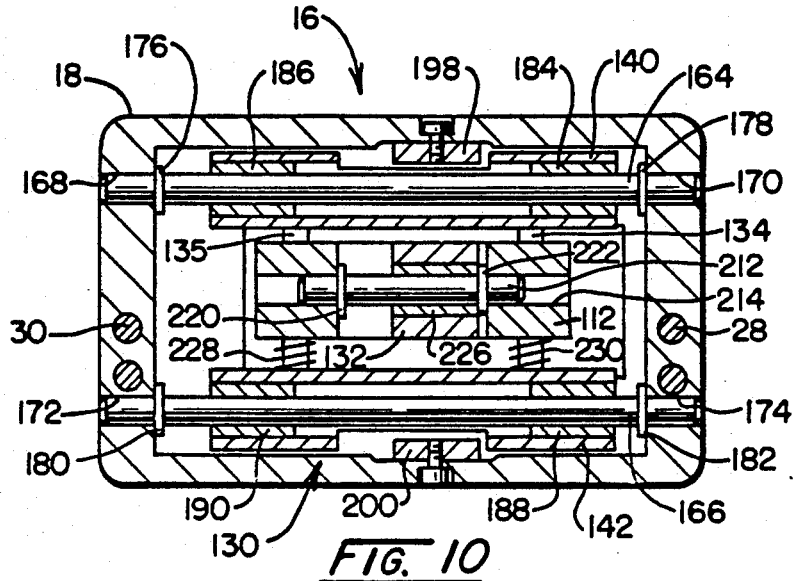
FIG. 10 is a sectional view taken through the plane 10—10 shown in FIG. 8.

Carriage 130 itself is drivably movable in a corresponding x-axis or transverse direction from link 144. turning additionally to FIG. 10, a mounting of component 130 for achieving this transverse or x-directional movement is revealed. In FIG. 10, two rods 164 and 166 are seen extending across housing 18, rod 164 being supported within bores 168 and 170 and rod 166 being supported in corresponding bores 172 and 174. Rod 164 is retained in the orientation shown by C-ring retainers 176 and 178 which are positioned over small grooves formed in the rod. Similarly, rod 166 is mounted with corresponding retainers 180 and 182. Alternatively, rods 164 and 166 can be retained by four setscrews which bear on flats that are ground on the shaft ends. Rod 164 is seen to extend through two bearings 184 and 186 mounted within carrier 130 upper portion 140. In similar fashion, rod 166 is seen to extend through corresponding bearings 188 and 190 within lower disposed carrier component 142. Bearings 184, 186, 188, and 190 can be provided as the earlier-described composite fabric bearings which are connected by anaerobic adhesive to carrier 130.

Returning to FIG. 8, the link 144 is seen to extend rearwardly to support a rotary cam follower 192 which is, in turn, driven by a horizontal or transitional movement defining cam 194. Isolator component 132 is mounted both within the internal, U-shaped opening vertical access region 145 and the transverse access region 143 of carrier 130. Isolator 132 is mounted for slidable movement in a Y-axis or vertical direction only and, in this regard, is slidably positioned upon a rod 196. FIGS. 5 and 9 reveal that rod 196 is mounted upon upper and lower brackets shown, respectively, at 198 and 200 attached, in turn, to housing 14 by machine screws 202–205. The slidable mounting of the isolator 132 upon rod 196 is achieved by two spaced bearings 208 and 210 coupled with anaerobic adhesive to the surface of a bore formed within the isolator 132. FIGS. 5 and 10 reveal that the isolator 132 is connected to U-shaped carriage 112 by a horizontally-disposed rod 212 which is retained within a bore 214 within carriage 112 by C-ring retainers 220 and 222. To permit x-axis or transverse travel of carriage 112, rod 212 is seen to extend through a bore within isolator 132 carrying a bearing 226. Bearing 226 may be provided as the earlier-described composite fabric bearing and is retained with anaerobic adhesive within isolator 132. FIG. 10 further reveals that the carriage 212 is biased upwardly by helical springs as at 228 and 230. These springs provide an upwardly disposed bias against isolator 132 to improve the registry of a cam follower imparting vertical motion to it with an associated cam. FIGS. 5 and 8 show this drive arrangement, isolator 132 being structured having a rearwardly extending and upwardly disposed rotaty cam follower 236 which is captured within the cam slot 238 of a rotary vertical drive cam wheel 240. FIG. 5 shows the cam wheel 240 to be drivably mounted upon a shaft 242 which, in turn, is rotatably supported at its tip by a bearing 244 mounted within an upstanding forward support 246.

With the structuring thus described, the housing 18 of linear actuator assembly 16 is coupled to the rearwardly disposed housing 14 containing rotational cam drive equipment by a fastening arrangement including earlier-described screws 28 and 30 (FIG. 1) and alignment pins as are revealed in FIG. 9 at 250. The assemblage also requires that cam follower 192 extending from link 144 be inserted or captured within the cam profile 194 and that the vertical movement inducing cam follower 236 extending from isolator 132 be positioned and captured within the cam profile or track 238. Continuously running or rotating cams then will drive the isolator 132 and carrier 130 in a manner imparting the single plane, dual directional movement required of carriage 112 as discussed in conjunction with FIG. 7.

Returning to FIG. 8, the rotational, cam driven assemblage 12 is seen to contain the earlier-described transverse motion cam 194 which is shown mounted upon an axle or shaft 260 extending, in turn, to a bearing mount (not shown) within forward support 246. Shaft 260 additionally supports a small pinion gear 262, a timing disk 264, and is coupled to the output shaft 266 of an electric motor 268 such as d.c. or A.C. synchronous motor at a transversely extending rearward support plate 270. Motor 268 provides a common drive for both cams 194 and 240 and, when provided as an A.C. synchronous device, can advantageously be powered from A.C. sources commonly available within an industrial environment. Drive to cam wheel 240 is derived from pinion gear 262 which is meshed in driving relationship with a gear 274 attached, in turn, to shaft 242 of the cam wheel 240. Shaft 242 is seen, additionally, to extend to rotational support within rear support plate 270. The tooth ratio of gears 262 and 274 may, for example, be 7:1, the two cam wheels 194 and 240 being driven simultaneously.

Figure 11:
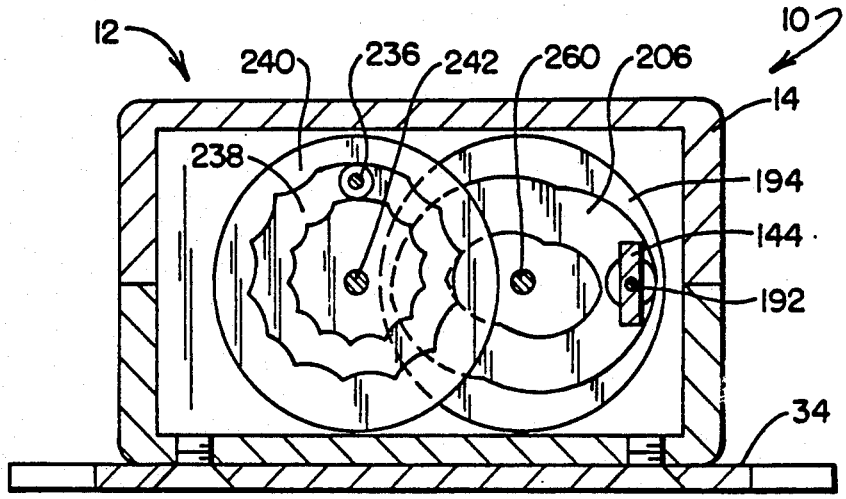
FIG. 11 is a sectional view taken through the plane 11—11 represented in FIG. 8.
Figure 12:
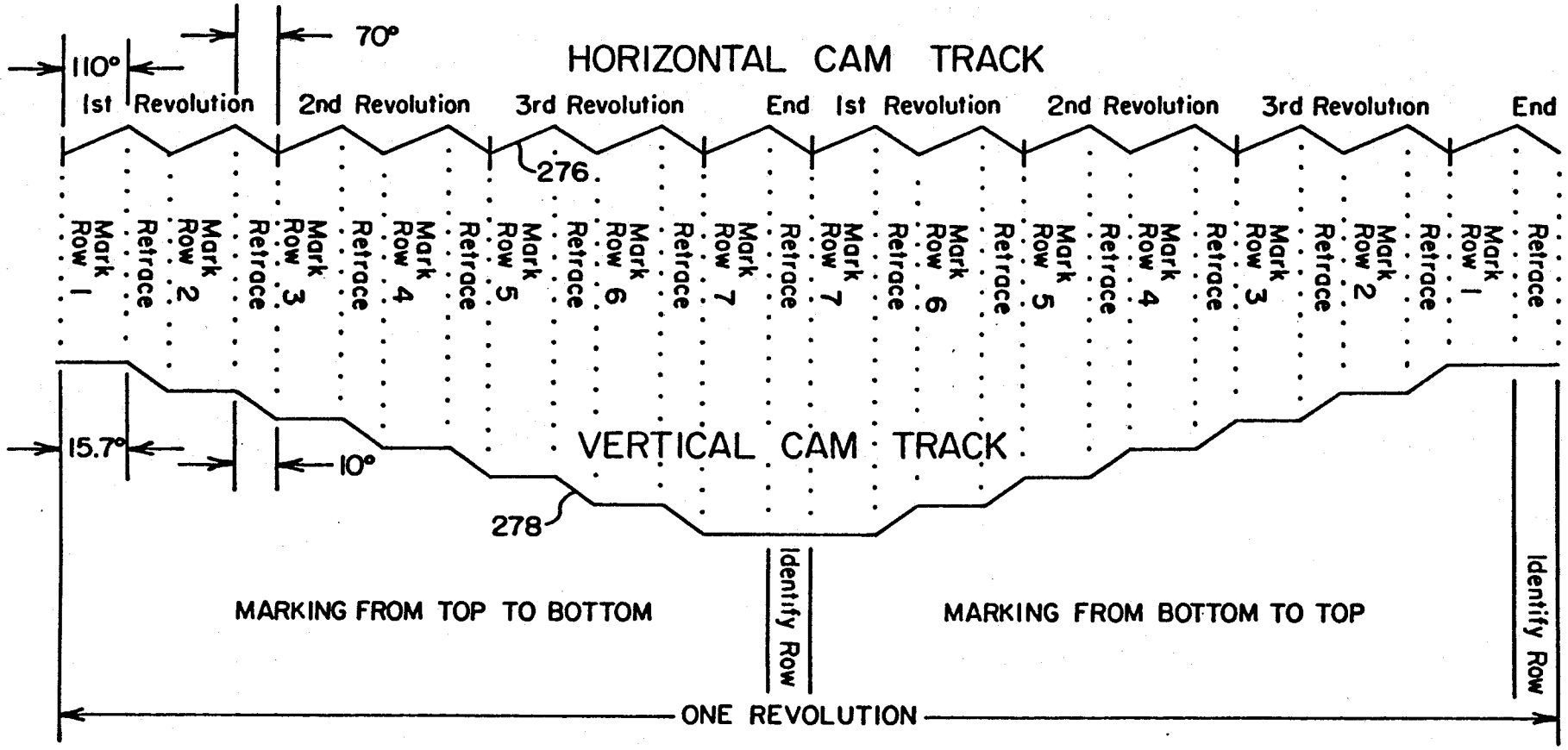
FIG. 12 is a diagrammatic representation schematically showing horizontal and vertical cam trace functions in accordance with the mechanism of the invention.

Looking to FIG. 11, the horizontal or transverse cam track or channel 206 is revealed in engagement with follower 192, while cam channel 238 of the vertical motion cam wheel 240 is shown engaging and capturing the vertical cam follower 236. Looking additionally to FIG. 12, the activity of these cam structures during simultaneous rotation converting rotary motion to linear motion is depicted. The transverse cam 206 is made up of two symmetrical halves, each consisting of a 110° sector to sweep the carriage, for example from left to right or from column 1 to column 11 positions as described in conjunction with FIG. 7. Additionally, this cam includes a 70° sector to retrace or return the carriage 112 to the column 1 position. The vertical cam structuring is represented by diagram line 278 and is seen to be made up of two symmetrical halves consisting of six transition sectors of 10° each, one dwell sector of 25.7° and six dwell sectors of approximately 15.7°. Note that the vertical cam track carries out a corresponding vertical movement of the carriage 112 during the retrace activity of the horizontal cam track.

Figure 13:
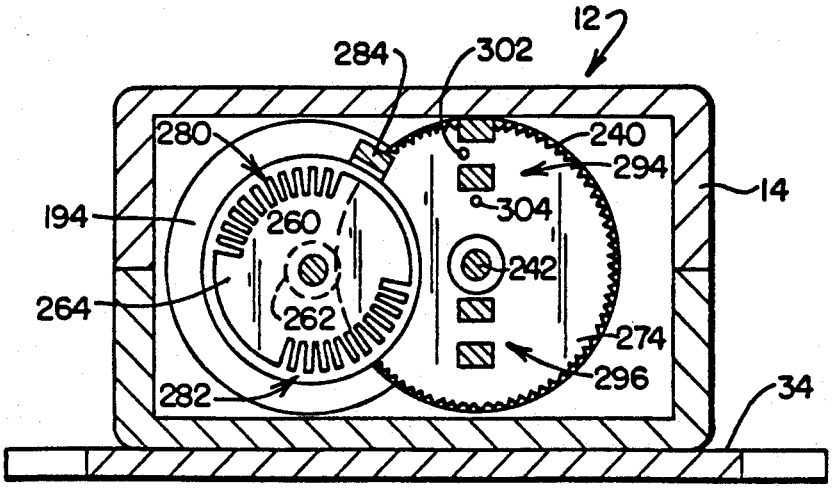
FIG. 13 is a sectional view taken through the plane 13—13 illustrated in FIG. 8.
Figure 14:
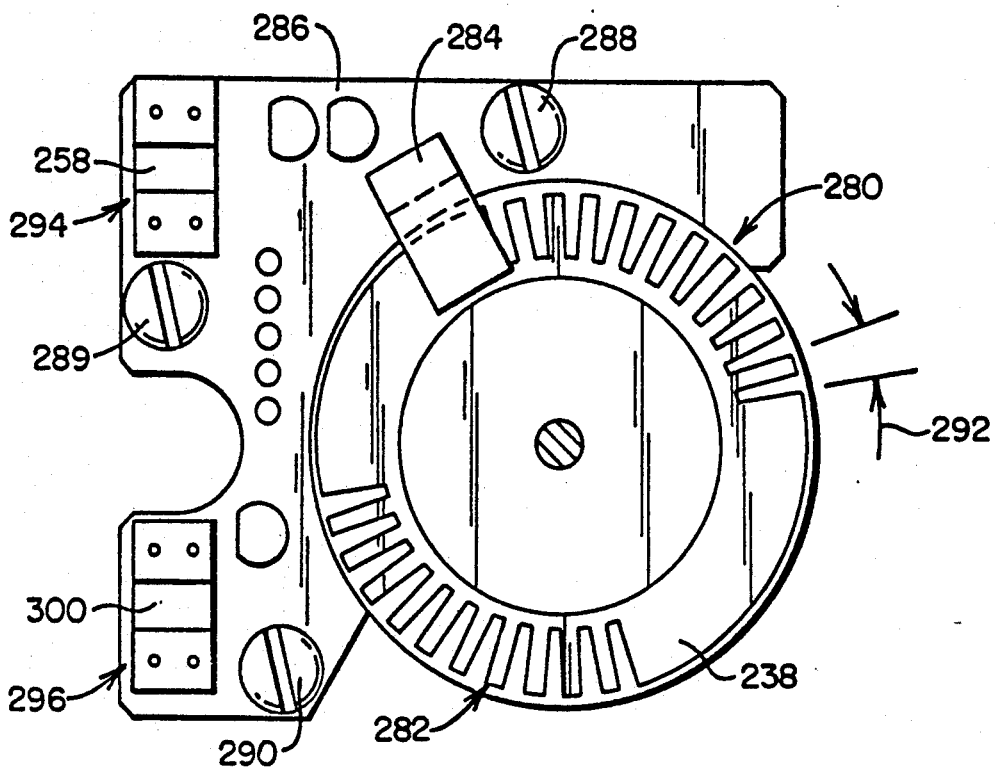
FIG. 14 is a plan view of a timing disk and associated circuitry employed with the invention.

Now considering the timing signal generation associated with the operation of the horizontal or transverse and vertical cams, reference is made to FIG. 13 where a frontal view of timing disk 264 is provided. Mounted upon the horizontal or transverse cam drive axel 260, the disk 194 is seen to be formed in the manner of a printed circuit board having alternate opaque and transparent sectors formed on the surface thereof as two symmetrically disposed arrays 280 and 282. Referring additionally to FIG. 14, the segment arrays 280 and 282 are positioned with respect to an interrupter module 284 mounted upon a printed circuit board 286. Board 286, in turn, is fastened by screws as at 288–290 to rearward support plate 270 (FIG. 8). Interrupter module 284 comprises a gallium arsenide infrared emitting diode optically coupled across a gap to a silicon, Darlington connected phototransistor within a plastic housing. Device 284 may be provided, for example, as a H22 B interrupter module marketed by General Electric Company. Thus, as the sector arrays 280 and 282 pass through the gap within device 284 separating these components, signals may be generated to present controlling electronics equipment with information representative of the horizontal (column) locations for matrix pixel placement in the horizontal axis or transverse direction. In this regard, it may be observe that 11 transistions are present in each of the arrays 280 and 282, a configuration developing the character formation technique for each pin described in conjunction with FIG. 7. For the 11 sector architecture shown, the sector period as represented by angle 292 will be 9.167°.

Figure 15:
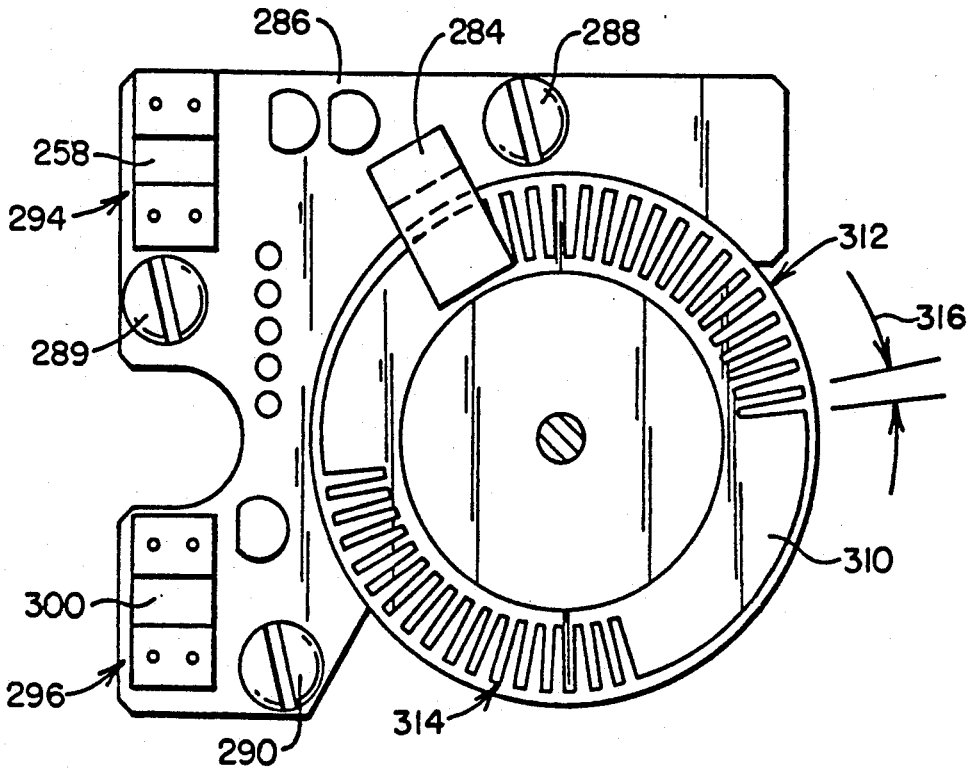
FIG. 15 is a plan view showing another embodiment for a timing disk and associated circuitry employed with the invention.

Two additional interrupter modules which are identical to that at 284 are shown mounted upon circuit board 286 at 294 and 296 (FIG. 15). Modules 294 and 296 are seen to be mounted such that their centrally disposed interrupter gaps respectively as at 298 and 300 are outwardly disposed from board 286. Looking additionally to FIG. 13, interrupter modules 294 and 296 are seen to perform in conjunction with two rod-like flags 302 and 304 extending outwardly from gear 274. It may be recalled that gear 274 operates in conjunction with the rotational input deriving vertical movement of carriage 112. Flag 302 is so positioned with respect to module 294 and flag 304 is so positioned with respect to module 296 such that the respective top and bottom rows of matrix character definition may be identified. Thus, returning momentarily to FIG. 7, flag 302 will generate a signal for module 294 at some point in time during the retrace from position L of locus line 122 to position A of locus line 120. This will indicate a top row positioning. Similarly, flag 304 will create a signal from module 296 during a retrace occurring between position F as represented at locus 120 and position G as represented at locus 122. Vertical carriage 112 position being determined by the position of flags 302 and 304, a marking procedure may be carried out from either the top or bottom row of the pixel matrix, whichever is detected first. Assuming top row 1 is detected first, then marking will begin at position A as shown in FIG. 7. With the position of carriage 112 having been determined, timing disk 264 will be rotated until the first column pixel signal sector is detected by module 284. At this time, the controlling circuit will commence outputting signals to actuator solenoid valves at 64 as required for the construction of a given character within the dot matrix image. As the carriage 112 is swept from point A to point B of locus 120 during 110° of rotation of the horizontal cam wheel 194, the marker pins as within arrays 36 and 38 will be actuated to achieve character formation. Simultaneously, the vertical cam wheel 240 will rotate approximately 15.7° through one dwell sector, and consequently impose no vertical movement upon the carriage 112. During the horizontal retrace, for example from point B to point C (FIG. 7), the horizontal cam wheel 194 will be rotated 70° while the vertical cam wheel 240 rotates 10° through one transition sector causing the carriage 112 to index down to row 2. This cycle is repeated six times until the carriage 112 is at point F, at which time the drive motor assembly 268 is turned off. Because of the symmetrical shape of the cam tracks involved, the horizontal cam wheel 194 will have completed 3½ revolutions and the vertical cam wheel 240 will have completed one-half of a revolution.

A next subsequent marking cycle, as described above in conjunction with locus 122 in FIG. 7, will begin by energizing the drive motor assembly 268 again in the same direction, while the system awaits reception of a position signal. During this interval, the vertical cam 238 remains on an extended dwell, causing carriage 112 to remain in the lower row or seventh row location. Carriage 112 now is traversing from what may be considered position H to position G, and if the position of the drive components has not been disturbed, the bottom row detector or interrupt module 296 will be actuated. The resultant position signal will occur before position G is reached and marking will commence at position G and continue while the carriage 112 sweeps across from position G to position H. The vertical cam wheel 240 will now rotate through another transition sector causing the carriage 112 to be indexed up to the next adjacent row or row 6 as it is swept back to position I. This cycle also will repeat six times, until the carriage 112 reaches position L and the motor assembly 268 is turned off. The vertical cam 238 again will remain on an extended dwell as a subsequent marking cycle will traverse the carriage 112 from position L or B to the position A to commence the next cycle.

Two major advantages accrue with the above described arrangement wherein marking for a given print cycle is performed in a uni-directional manner or, as an example, from left to right. Initially, a uniform horizontal pixel placement is achieved. Poor pixel spacing results from inherent lost motion in the carriage 112 and its associated drive. When marking in one direction only, according to the invention, the lost motion phenomenon has no effect on marking inasmuch as it is a constant. The column pixel detector 284 can be located within a relatively broad tolerance range, since all rows will have the same timing characteristics and, consequently, horizontal placement will be quite stable. Should the column detector 284 be slightly advanced or retarded from its design or ideal position, the resultant columns will remain properly aligned, however, slightly expanded or compressed between the first and second or tenth and eleventh columns. A slight compression or expansion between the end columns is barely noticeable and generally unobjectionable.

A next advantage of uni-directional marking resides in the clarity, or contrast of the resultant impacted dot matrix characters. When the dots or indentations are formed by a marker pin which is moving across the surface of the material, as well as up and down into the material, the resultant indentations or dots tend to be slightly oblong. As light strikes such an indented surface, a resultant perceived image can be difficult to read. This situation is worsened when the indentations are sufficiently close to each other such that a subsequent indent overlaps a previous indent. Since bi-directional marking would cause adjacent rows to be marked in opposite directions, the resultant overlapping indentations will exhibit extremely different lighting shades and contrasts, making recognition difficult.

Looking to FIG. 15, an alternate configuration for the column defining timing disk is represented at 310. Disk 310 is shown in association with earlier-described axle or shaft 260 and, circuit board 286 and interrupter modules 284, 294, and 296. Note, however, that the oppositely disposed sector arrays 312 and 314 are provided having a different configuration. In particular, the angular period 316 of these sectors is 6.11° to permit the apparatus 10 to carry out marking three characters with respect to each pin of the arrays 36 and 38. Note that 17 pulse defining sectors are provided within each of the arrays 312 and 314.

Figure 16:
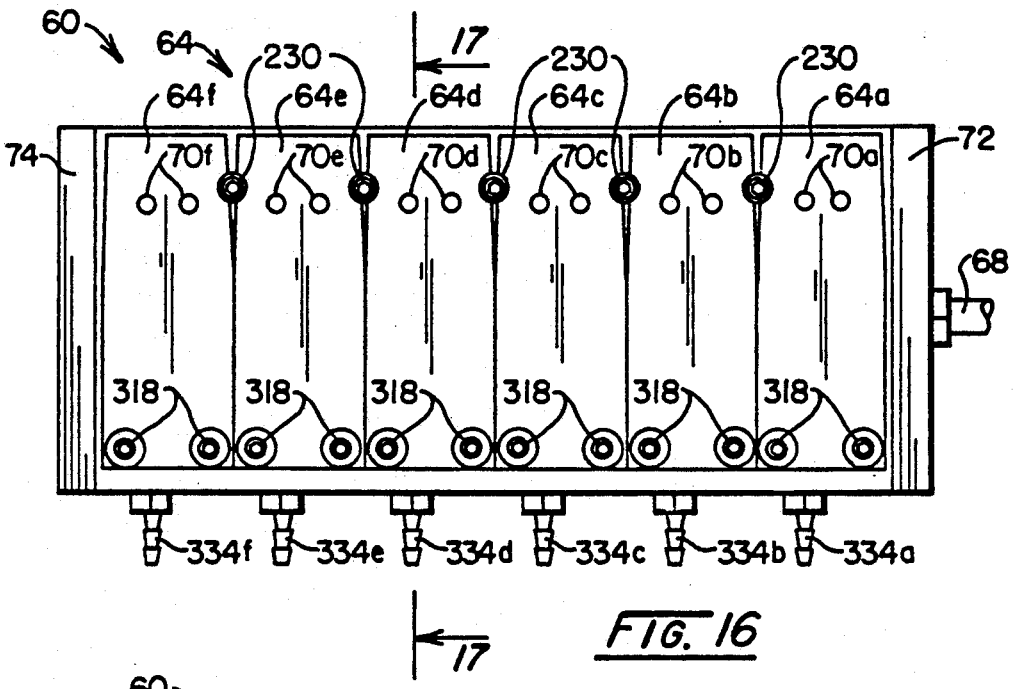
FIG. 16 is a top view of a component of the apparatus revealed in FIG. 1.
Figure 17:
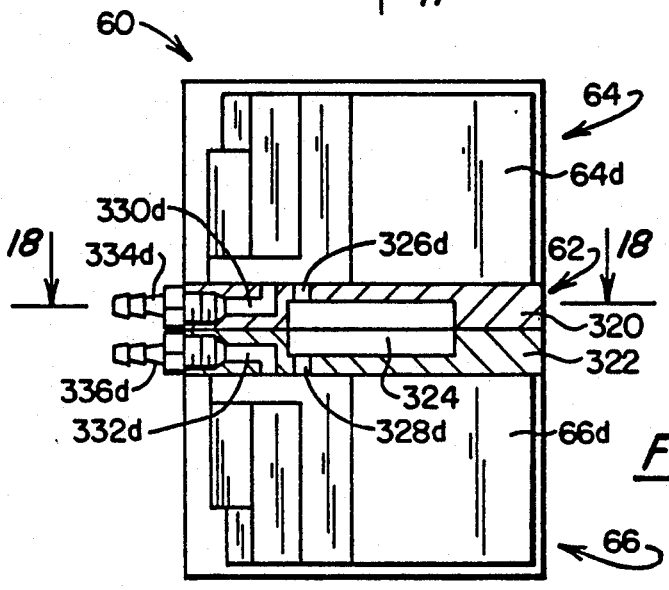
FIG. 17 is a sectional view of the apparatus of FIG. 16 taken through the plane 17—17 illustrated therein.
Figure 18:
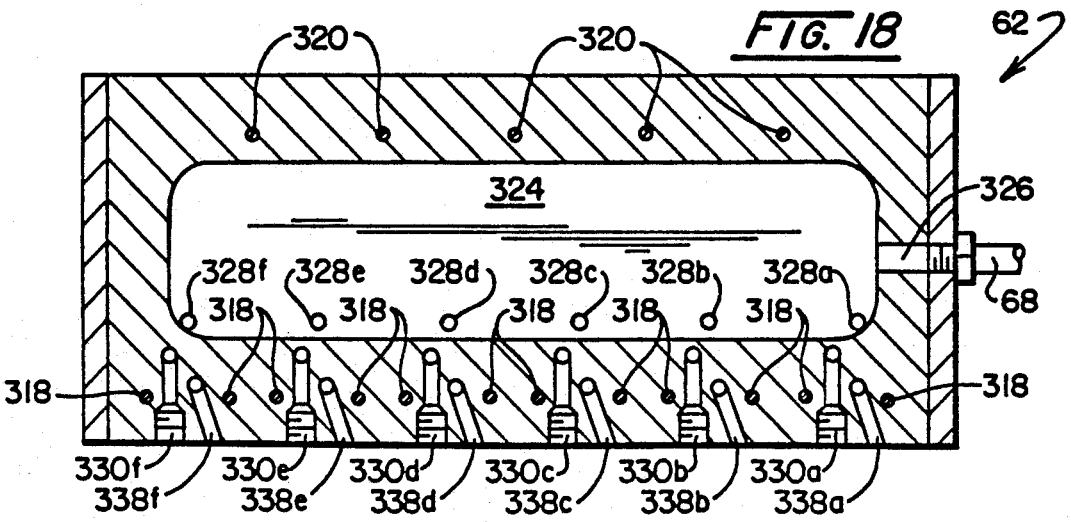
FIG. 18 is a sectional view taken through the plane 18—18 illustrated in FIG. 17.

Referring to FIGS. 16–18, the pneumatic drive assembly 60 is portrayed at a higher level of detail. In FIG. 16, the array of solenoid driven valve assemblies is now revealed as six units 64*a*–64*f*. These devices, as before, are seen assembled between end plates 72 and 74 and are bolted in modular fashion to the drive assembly manifold 62 by an array of paired bolts 318 at the forwardly disposed portion of the device. Valve assemblies within arrays 64 and 66 may be those marketed, for example, by the Mac Valve Corporation, Detroit, Mich.

Looking to sectional FIG. 17, the drive assembly manifold 62 is revealed in section as it occurs beneath solenoid actuated valve assembly 64*d* and above corresponding solenoid actuated valve assembly 66*d*. Manifold 62 is seen to be formed of two plates 320 and 322 which are machined so as to form an air chamber 324 when joined together. FIG. 18 reveals a sectional view of this chamber as being fed via port 326 and air supply 68. Chamber 324 supplies air under pressure in common to the inputs of the solenoid actuated valves within arrays 64 and 66, two such inputs for valve assemblies 64*d* and 66*d* being shown in FIG. 17 respectively at 326*d* and 328*d*. The array of air input ports leading to valve assembly 66 are seen in FIG. 18 at 328*a*–328*f*. FIG. 17 also shows valve output ports 330*d* and 332*d* emanating from respective valve assemblies 64*d* and 66*d*. The corresponding array of valve output ports for valve assemblies 64*a*–64*f* are seen in FIG. 18 respectively at 330*a*–330*f*. Note in FIGS. 16 and 17, tubing connectors are threadably coupled with these valve output ports, the array associated with valves 64*a*–64*f* being represented, respectively, at 334*a*–334*f*. The corresponding output connector for valve port 332*d* is shown in FIG. 17 at 336*d*. A third port associated with each of the valves of arrays 64 and 66 provide pneumatic communication with the atmosphere. The atmospheric ports for valve arrays 64*a*–64*f* are seen in FIG. 18, respectively, at 338*a*–338*f*. Finally, the actuating leads to each of the valve assemblies as represented in general at 70 in FIG. 1 for array of valve assemblies 64 is shown in FIG. 16 as input bores respectively revealed at 70*a*–70*f*.

The utilization of a common chamber as at 324 for receiving high pressure air, for example air at 100 psi achieves substantial operational advantages for pneumatically actuated dot matrix devices as represented herein and for similar or earlier devices described above. In this regard, the earlier devices typically employed long drilled ports with small cross ports leading to individual valves to carry actuating pressurized air. When these valves are actuated utilizing a source of air under pressure not from such a chamber as at 324, performance tends to degrade in the event of simultaneous actuation. The latter phenomenon occurs quite frequently with the type devices at hand. This degradation in upstream or downstream valve performance is particularly observable where higher speed actuation is called for utilizing the noted higher pressures. With the utilization of the common chamber as at 324 with higher pressures, an activation of any particular solenoid valve utilizes only a small portion of the air available within chamber 324. Accordingly, the earlier-observed degradation of performance is not present, i.e. the chamber arrangement achieved permits high speed actuation of the valves utilizing high pressure air with essentially no degradation of performance. Thus, the chamber as at 324 is selected of a size effective to substantially eliminate degradation of performance of the marker pins of the arrays to which it is coupled.

As is apparent from the foregoing, the addition or subtraction of valve assemblies in the field for any given configuration of pin arrays as at 36 and 38 is easily carried out. For any required alterations, essentially only the impact pin containing structure 22, manifold 20, and pneumatic drive assembly 60 are altered, a function readily carried out in the field. By separating this pneumatic actuating or drive assembly from intimate association with the marking control apparatus, internal contamination from the lubricant carrying air supply employed for actuating the marker pins at arrays 36 and 38 is eliminated.

Figure 19:
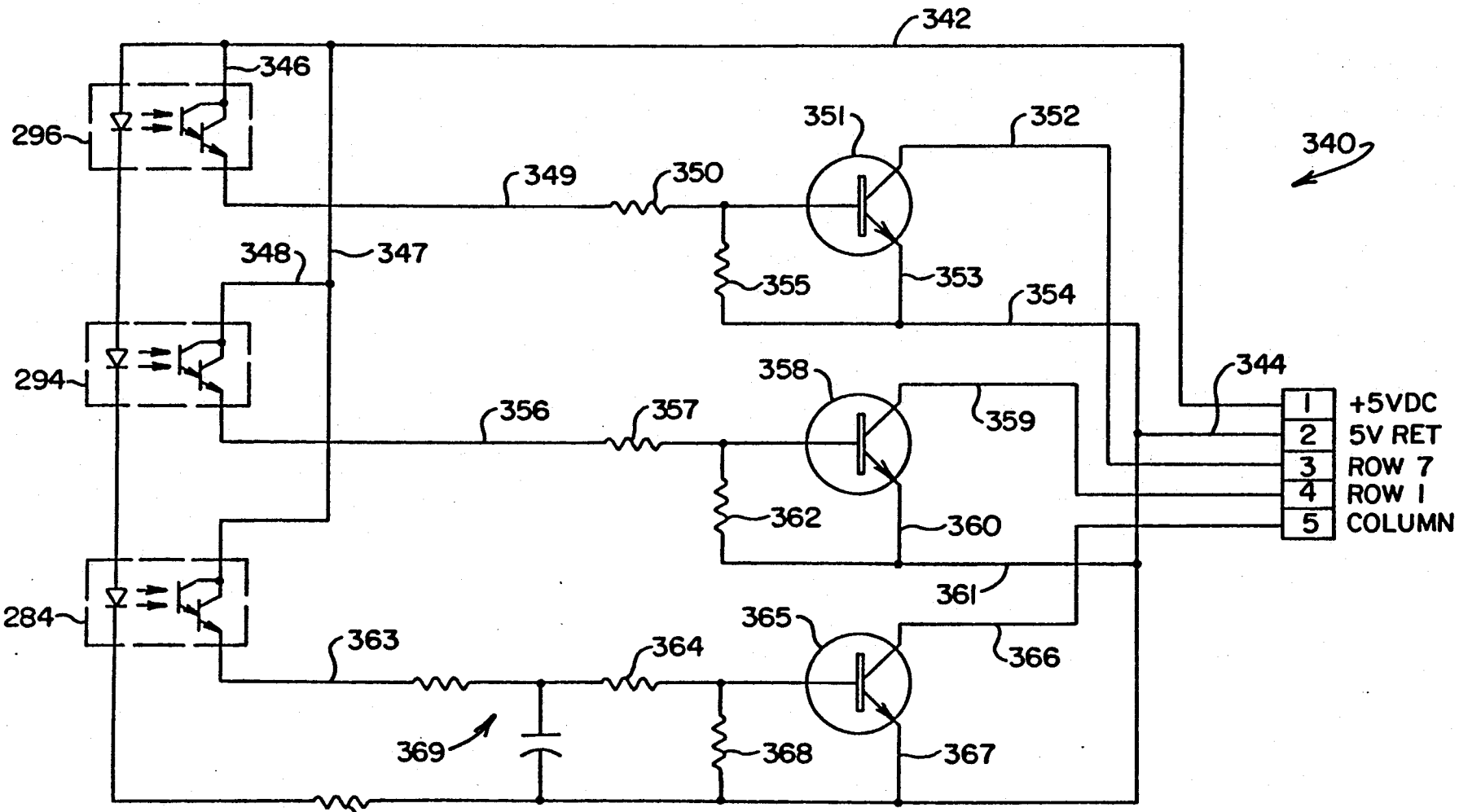
FIG. 19 is a schematic diagram of a timing output circuit employed with the invention.

Referring to FIG. 19, the timing output circuit as described as being mounted upon circuit board 286 in conjunction with FIGS. 14 and 15 is revealed generally at 340. Circuit 340 includes power leads 342 and 344 extending respectively from +5 v d.c. and 5 v return. Lead 342 is seen extending to the anode of a gallium arsenide infrared emitting diode within each of the earlier-described interrupter modules 294, 296 and 284. A current limiting resistor 345 is inserted within lead 342 in conjunction with this diode excitation function. All other emissions from the photodiodes in each of the modules 294, 296, and 284 react across a gap with silicon Darlington coupled transistor pairs the collectors of which are connected to line 342 via line 346 in the case of module 296; lines 347 and 348 in the case of module 294; and line 347 in the case of module 284. Correspondingly, to evoke an open collector output, the emitters of the Darlington coupled transistors for module 296 are connected via line 349 and base resistor 350 to the base of NPN transistor 351. The collector of transistor 351 provides the output signal emanating from device 296 at line 352 while the emitter thereof is coupled via lines 353 and 354 to line 344 for return. A resistor 355 in line 354 couples the base of transistor 351 to ground.

In similar fashion, the emitter of the Darlington connected transistor pair of device 294 is coupled via line 356 through base resistor 357 to the base of NPN transistor 358. As before, the collector of transistor 358 provides an output signal at line 359 corresponding with row 1 information at line 359, while the emitter of transistor 358 is coupled via lines 360 and 361 to ground or return. Line 361 also connects through resistor 362 to the base of transistor 358. Finally, the emitter of the Darlington coupled transistor pair of module 284, which is quite frequently actuated to provide column definition is coupled via line 363 and base resistor 364 to the base of NPN transistor 365. The collector of transistor 365 provides an output signal at line 366 for column definition, while the emitter thereof is coupled via line 367 to lines 342 and 344. A resistor 368 couples the base of transistor 365 to return or ground, while a low pass filter comprised of a resistor and capacitor represented generally at 369 functions to dissipate any electromagnetic interference which might be occasioned from solenoid actuation, albeit remote from the device.

Figure 20A:
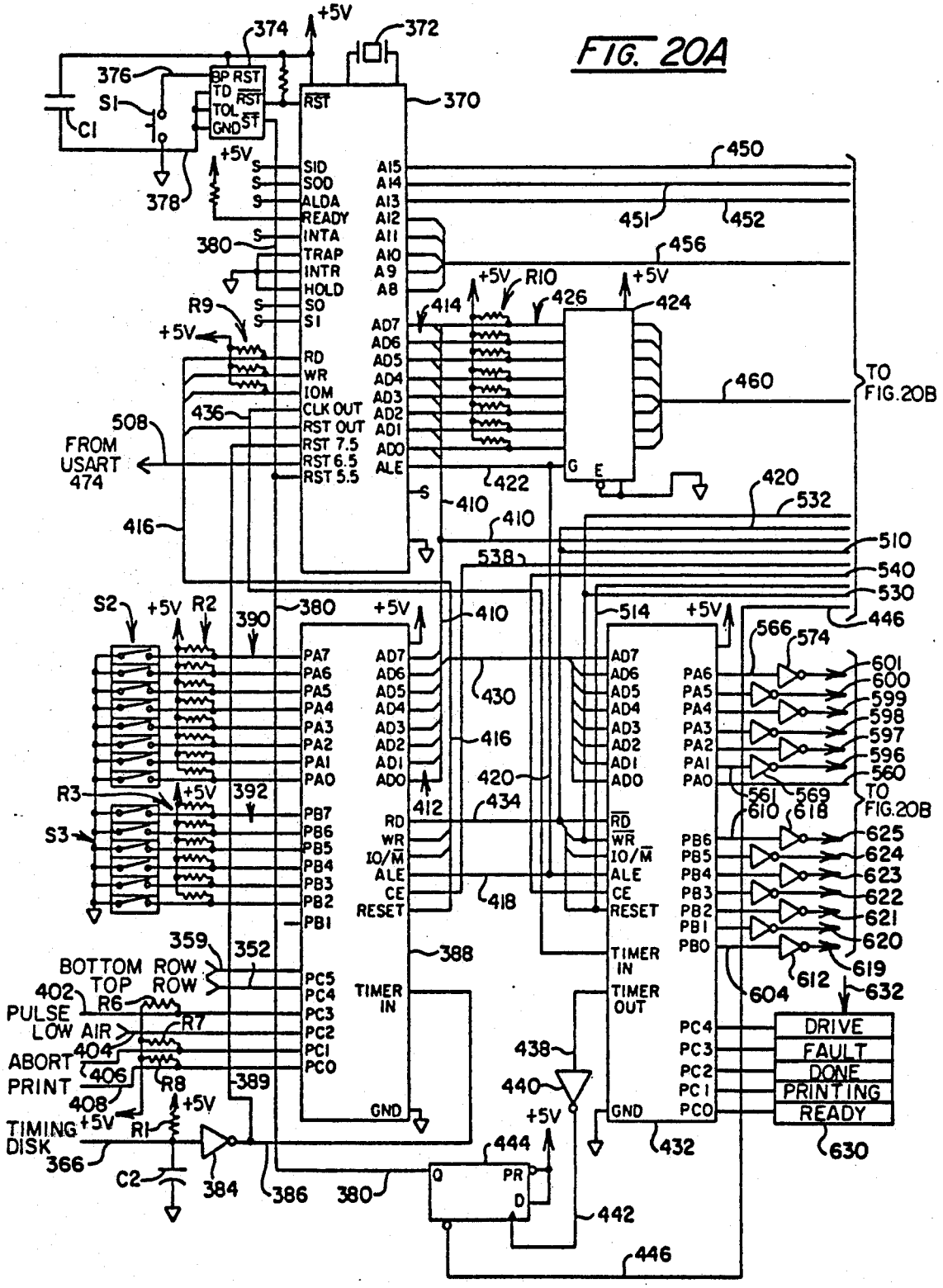
FIGS. 20A-20C combine to show an electronic schematic diagram of the control system employed with the apparatus of FIG. 1.
Figures 20B, 20C:
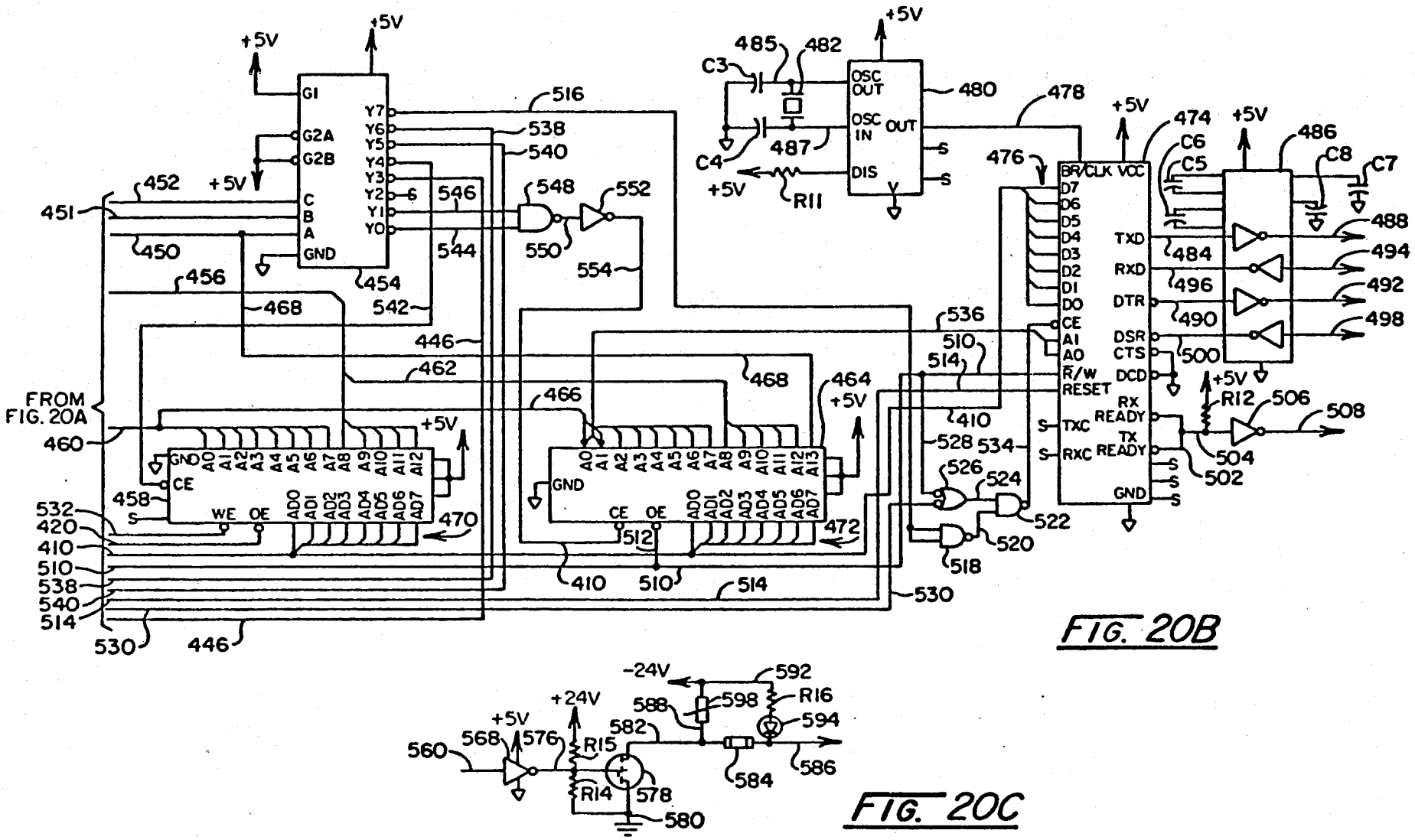

Referring to FIGS. 20A–20C, an electrical schematic representation of the control asserted over the solenoid driven valve assemblies as arrayed at 64 and 66, as well as the motor assembly 68 is provided. These figures should be considered in the orientations represented by their intermutual labeling. FIG. 20A shows the control to be microprocessor driven, in this regard employing an 8-bit CMOS microprocessor 370 which may, for example, be a type 8085 marketed by Intel Corporation. Microprocessor 370 performs in conjunction with an 8 MHz clock input provided, for example, by a crystal 372. The high level-sensitive reset input RST 5.5 to the microprocessor 370 is derived from the RST output of a micromonitor 374 which responds not only to hand actuations of a switch S1 coupled to the device via lines 376 and 378, but also from line 380 leading to power-down components of the circuit. In effect, the device 374 functions to reset the device 370 quickly in the event either of actuation of switch S1 or of a power drop, for example, occasioned during power down to avoid spurious writing to memory under such events. A filtering capacitor C1 is shown coupled about switch S1 within line 378.

Microprocessor 370 operates in a program interrupt fashion in conjunction with the timing disk pixel signals derived at lines 352, 359, and 366 (FIG. 19). Pixel defining signals from line 366 are introduced to the input of an inverting Schmitt trigger 384 which functions, inter alia, to improve the rising edge characteristic of the timing disk developed pulse. This input at line 366 is pulled up to +5 v through resistor R1 and is filtered by capacitor C2 shown coupled between line 382 and ground. The output of trigger 384 at line 386 is shown being directed via line 389 to the RST 7.5 terminal of microprocessor 370 which reacts thereto in interrupt programming fashion. Line 386 also is directed to the timer in port of a type 8155 RAM-I/O-timer device (RIOT) 388. Device 388 is multifunctional incorporating random access memory (RAM) as well as input-/output functions and timing functions. In the latter regard the pixel defining pulse at line 386 asserted thereto is divided down for timing purposes in the system. The I/O function of device 388 is provided at the P designated terminals. In this regard, it may be observed that terminals PA0–PA7 are coupled through lead array 390 to the d.i.p. switch array represented at S2. Each of the leads within array 390 are coupled to +5 v through a pull-up resistor of resistor array R2. Similarly, terminals PB2–PB7 are coupled through lead array 392 to an array of corresponding d.i.p. switches identified at S3. Each of the leads 392 is coupled to +5 v through pull-up resistors represented at resistor array R3. Switches S2 and S3 may be selectively manipulated by the user to provide any of a number of functional parameters for operation of the system. Such parameter selections may, for example, include election of different system configurations, for example, in the matrix defining the characters such as a 5×7 type or 5×5 type character font, baud rate configurations, handshake protocols, count rates and the like. Lines 359 and 352 are shown directed, respectively, to the PC5 and PC4 terminals of device 388 and carry the status of the top row and bottom row interrupter modules 294 and 296 (FIG. 19). Device 388 also forms the input for push-button type commands and the like which may be desired for the system. For example, the solenoids of the valve assembly arrays 64 and 66 may be selectively pulsed for diagnostic purposes by a signal presented along line 402 as coupled to +5 v through pull-up resistor R6. Low air may be monitored and the status thereof provided at line 404. An abort signal input may be provided, for example, along line 406 which is coupled through pull-up resistor R7 to +5 v and a command to print or actuate the solenoid actuated valves to create a message may be provided by command at line 408 which is shown coupled to +5 v through pull-up resistor R8.

The address ports of RIOT 388 as at AD0–AD7 are shown coupled to the microprocessor 370 through the eight lead microprocessor bus 410 via lead array 412. Bus 410 may be seen directed to the corresponding AD0–AD7 address-data ports of microprocessor 370 through lead array 414. Control input to device 388 at its RD, WR, IO/$\overline{M}$, and reset inputs are provided from four line bus 416 which extends to the corresponding terminals of microprocessor 370. In this regard, it may be noted that the $\overline{RD}$, $\overline{WR}$, and IO/$\overline{M}$ ports are coupled through pull-up resistor array R9 to +5 v. The address latch enable (ALE) terminal of device 388 is coupled via lines 418, 420 and 422 to the corresponding ALE input of microprocessor 370. Line 422 additionally is seen to extend to the G input terminal of a latch 424 which may be provided, for example, as a type 74ALS573. The remaining inputs to latch 424 are provided from eight lead bus 410 via lead array 426, the discrete line inputs thereof being coupled through the resistors of resistor array R10 to +5 v.

Eight lead bus 410 leading from the address/data ports of microprocessor 370 also is seen to branch at bus 430 to address a second type 8155 RIOT device 432 at the corresponding AD0–AD7 ports thereof. Additionally, it may be observed that control inputs via four lead bus 416 are provided via branch 434 to the $\overline{RD}$, $\overline{WR}$, IO/$\overline{M}$ and reset terminals of device 432. Line 418 commonly connects the address latch enable (ALE) terminals of devices 388 and 432. The timer input of device 432 is employed and in this regard, the clock output of microprocessor 370 is shown coupled to that input via line 436. The timer output of device 432 is coupled via line 438 to an inverter buffer 440 and from the output thereof at line 442 to the input of a D flip-flop 444 which may, for example, be provided as a type 74LS74A. The clear input to flip-flop 444 is provided from line 446 and the Q output thereof is coupled via earlier-described line 380 to restart input RST 5.5 of microprocessor 370 and to the $\overline{ST}$ input of micromonitor 374. With the arrangement, when the output at line 438 is high, flip-flop 444 is clocked to a logic high value to provide an interrupt.

Address terminals A13–A15 of microprocessor 370 are coupled via respective lines 450–452 to the corresponding A–C inputs of a three line to eight line decoder shown in FIG. 20B at 454. Adjacently disposed address terminals A8–A12 of microprocessor 370 are shown coupled by five line bus 456 to the corresponding terminals A8–A12 of a calendar and real time device 458 (FIG. 20B) which further incorporates a CMOS random access memory (RAM) feature the latter being non-volatile by virtue of an embedded lithium energy source. Device 458 further monitors $V_{cc}$ for any out of tolerance condition. When such condition occurs, the source is switched on and write protection is enabled to prevent loss of watch or calendar and RAM data. Such devices are marketed under the designation "Smartwatch" type DS1216 by Dallas Semi-Conductor, Inc. The remaining address terminals A0–A7 of device 458 are coupled to eight line bus 460 leading, in turn, to the A0–A7 output terminals of latch 424. Bus 456 additionally is seen to branch at bus 462 for connection with address inputs A8–A12 of a programmable read only memory (PROM) 464. Memory 464 may be provided, for example, as a type 27128 16K×8 KUV-erasable PROM having an output enable (OE) which is separate from the chip enable control (CE). The device is marketed, for example, by Intel Corporation. PROM 464 additionally is addressed from eight line bus 466 branching from bus 460 leading, in turn, to latch 424. The A13 terminal of PROM 464 is seen coupled to line 450 via line 468. Address/data terminals AD0–AD7 of both devices 458 and 464 are shown coupled from respective lead arrays 470 and 472 to the microprocessor bus 410.

Bus 410 additionally is seen to extend to the data input terminals D0–D7 of a universal synchronous-/asynchronous data communications controller (USART) 474 through lead array 476. Device 474 accepts programmed instructions from bus 410 for supporting serial data communication disciplines and, conversely, provides for parallel outputting at bus 410 of serially received data. Its baud rate generator input clock (BR/CLK) is seen to be coupled via line 478 to the output of a CMOS clock generator 480. Provided, for example as a type ICM 7209 marketed by General Electric-Intersil, generator 480 is comprised of an oscillator having a buffered output corresponding therewith and performs in conjunction with a crystal oscillatory device operating at 5.0688 MHz as represented at 482 coupled between lines 485 and 487, in turn incorporating filter capacitors C3 and C4. A disable terminal (DIS) of device 480 is shown coupled through resistor R11 to +5 v.

The data transmitting output of USART 474 is provided at line 484 which, in turn, is directed to a dual RS-232 transmitter/receiver 486. Provided, for example, as a model MAX 232 marketed by Bell Industries, Inc. of Dayton, Ohio, the device contains two RS-232 level translators which convert TTL/CMOS input levels into ±9 v RS-232 outputs. Additionally, two level translators are provided as RS-232 receivers which convert RS-232 inputs to 5 v TTL/CMOS output levels. Accordingly, line 484 is seen directed to an output level translator to provide a corresponding RS-232 output at line 488. In similar fashion, the data terminal ready signal at line 490 is directed to the second RS-232 level translator-transmitter for transmission via line 492. Receipt of serial data is provided at line 494 which is directed through the receiver level translator of device 486 for presentation at line 496 to the data receiving terminal (RXD) of USART 474. Finally, the data set ready input is provided at line 498 for level translation at device 486 and presentation to the DSR input of USART 474 via line 500. The receiver ready and transmitter ready output terminals of USART 474 are coupled in common at lines 502 and 504, the latter being coupled through pull-up resistor R12 for presentation through Schmitt trigger inverter 506 to the microprocessor restart interrupt terminal RST 6.5 via line 508. Read/write logic input to device 474 is provided from line 510 which is seen to extend in common to the output enable (OE) terminal of EPROM 464 via line 512 and to line 420 which additionally extends to the output enable (OE) terminal of RAM 458. Line 420 has been described in conjunction with FIG. 20A as being coupled to the ALE terminal of microprocessor 370 via line 422. A reset input to device 474 is provided from line 514 which is coupled to the corresponding reset input to RIOT 432 (FIG. 20A) which is controlled, in turn, via branch bus 434 from the reset out terminal of microprocessor 370. Enablement to device 474 emanates from decoder 454 at terminal Y7 thereof and line 516 which is seen to extend to both inputs of a NAND gate 518 the inverted output of which at line 520 is directed to one input of a two input NAND gate 522. The opposite input to gate 522 is provided at line 524 from NOR gate 526. Gate 526 receives one output from the read/write command at line 510 via line 528 and an opposite input from line 530 extending, in turn, to line 532. As seen in FIG. 20A, line 532 is joined with the write input line of bus 434, extending, in turn, to four line bus 416 and microprocessor 370.

Returning to FIG. 20B, line 532 also is seen to extend to the write enable (WE) terminal of RAM-clock device 458. With the above input logic, NAND gate 522 provides a chip enable (CE) input to device 474 via line 534. Finally, the internal register select terminals A0, A1 of device 474 are coupled via line 536 to the two leads of branch bus 466 extending to the A0, A1 input terminals of PROM 464.

The Y6 terminal of decoder 454 provides an enable output at line 538 which extends, as shown in FIG. 20A to the chip enable (CE) input terminal of RIOT 388. Similarly, the Y5 terminal of decoder 454 extends via line 540 to the corresponding chip enable ($\overline{CE}$) terminal of RIOT 432. Output terminal Y4 of decoder 454 is coupled via line 542 to the chip enable (CE) input of RAM-clock device 458. Next, terminal Y3 of decoder 454 is seen to be coupled via line 446 to the clear input of flip-flop 444 (FIG. 20A). Finally, the Y0 and Y1 terminals of device 454 are coupled via respective lines 544 and 546 to the inputs of NAND gate 548, the output of which at line 550 is directed to the input of inverting Schmitt trigger 552, the output of which at line 554 provides a PROM enable input to the CE terminal of memory PROM 464.

Returning to FIG. 20A, the output of RIOT 432 at terminal grouping PA0–PA6 is employed for one aspect of drive to the solenoid-valve assembly arrays 64 and 66. With the arrangement shown, an output drive capability for six such solenoid assemblies is represented at the line array extending between lines 560 and 566. Each of these lines is shown directed to the input of an associated inverter buffer-drivers. While these drivers are shown in symbolic form as an array extending, for example, from driver 569 through driver 574, one of the drivers as associated with line 560 is revealed in detail in FIG. 20C. The drivers provide high-voltage open drain outputs which function to drive high current loads as are encountered with solenoid driven devices. As noted earlier herein, two arrays 64 and 66 (FIG. 1) of such devices are driven under the instant design. Looking to FIG. 20C, that driver which is represented in detail with respect to line 560 is represented at 568. It should be understood that the remaining outputs at lines 561–566 are coupled with similar driver structures, as are the outputs from ports PB0–PB6. Driver 568 is shown coupled between +5 v and ground and provides an output at line 576 which is coupled to the gate of a MOSFET transistor 578. Transistor gate bias is applied to line 576 by a network of resistors, R14 and R15 coupled between +24 v supply and terminal line 580 leading to ground. Terminal line 582 extends through a fuse 584 and to output line 586 extending to the solenoid winding of one of the solenoid driven assemblies at 64 or 66. Line 582 is coupled by line 588, incorporating a metal oxide varister (MOV) 598 to −24 v supply and the latter supply is coupled by line 592, incorporating a current limiting resistor R16 and light emitting diode (LED) 594 which, in turn, is coupled to line 586. MOV 598 provides a protection against inductive spikes and the like, exhibiting a clipping function, while LED 594 functions to be illuminated with each solenoid activation and may be employed for diagnostic purposes. Similar outputs as at line 586 deriving from terminals PA1–PA6 of RIOT 432 are represented at lines 596–601 in FIG. 20*a*.

A similar solenoid drive arrangement is provided in conjunction with terminals PB0–PB6 of device 432. In this regard, an array of output lines connected to these terminals extending between lines 604 and 610 is seen being directed to the inputs of a corresponding array of buffers extending from buffer stage 612 to that at 618. The corresponding output lines as at 619–625 extend to the energization windings of a next array of solenoid windings, for example, as associated with solenoid array 66 (FIG. 1). In each instance, the output signals are treated at the buffer stages 612–618 in the same manner as described in conjunction with line 560.

A third sequence of ports PC0–PC4 of RIOT 432 serve to supply the selective drive to the motor assembly 268 (FIG. 8) and to provide indicia of certain tests and operations through the media, for example, of computer monitor screen print-outs, LED signals, or the like. In this regard, the outputs for each of the ports PC0–PC4 are directed to an industrial I/O single channel input/output module which may be selected to provide a corresponding a.c. signal or d.c. signal as the application requires. Such single channel modules are marketed, for example, by Opto 22, Inc., Huntington Beach, Calif. An array of input/output modules is represented in FIG. 20A by block 630 having a 60 Hz 110 v conventional a.c. input represented at arrow 632 and carrying the modules as labeled responding to the outputs of the noted terminals PC0–PC4.

Figure 21:
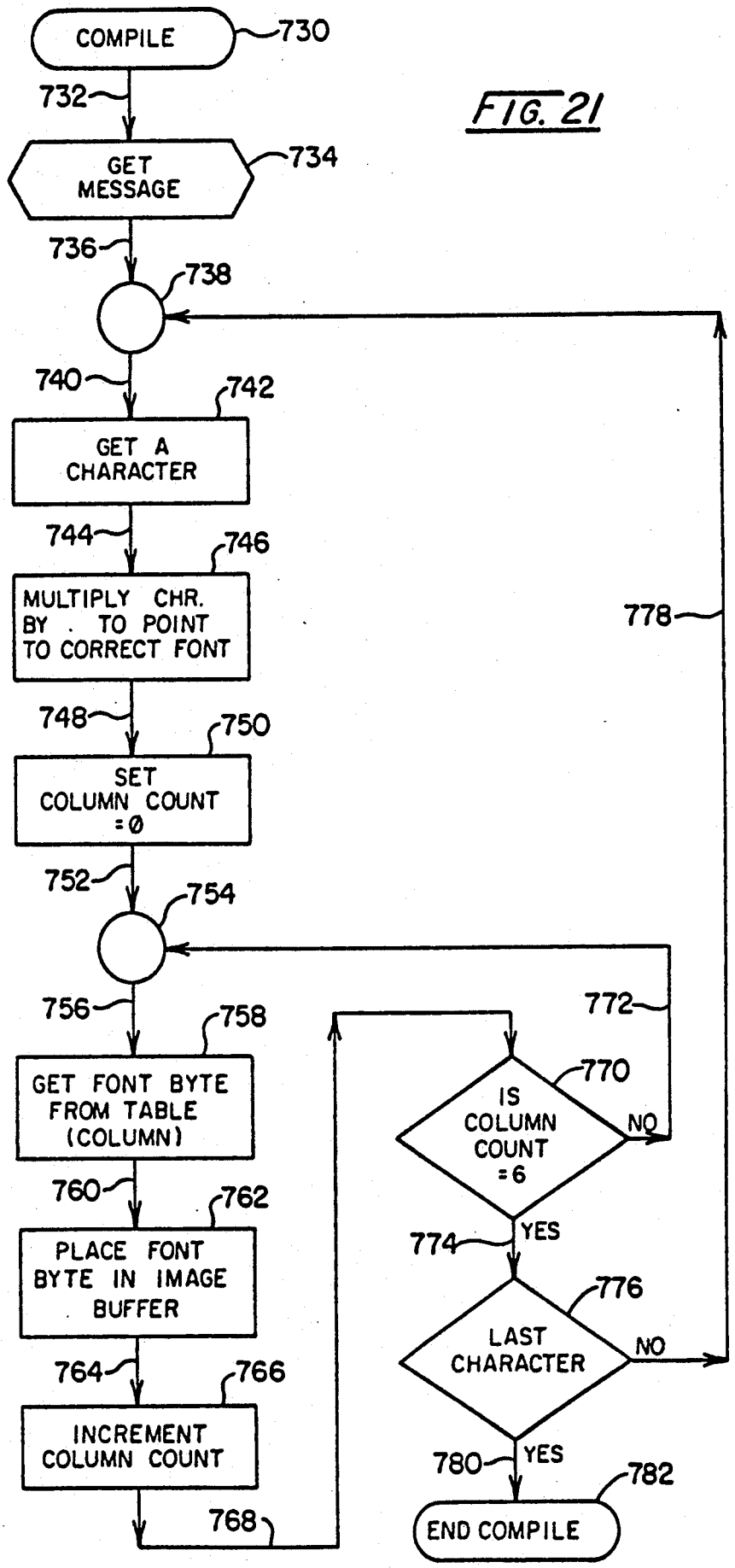
FIG. 21 is a flow diagram describing a compile routine employed in conjunction with the control developed with respect to FIGS. 20A-20C.

Referring to FIG. 21, a flow chart representing that portion of the control program of the apparatus 10 wherein a message is compiled for printing is provided. Additionally, reference is made to earlier-discussed FIG. 7 wherein a diagrammatic representation of the routine at hand is provided. A given message for printing will be received in serial data fashion from a personal computer, a host computer operating within an assembly line environment or by operator input keyed, for example from a small computer assemblage attached to the device 10 itself. Generally, a serial string of characters will be received followed by an ending signal such as a carriage return. The character matrix shown in FIG. 7, for the instant embodiment, will be provided for six pins, each pin moving along one of the loci 120 or 122 (FIG. 7). The compiling routine represented at FIG. 21 receives the message and accesses the font architecture from a look-up table with respect to each received character until such time as the fonts representing the message at hand are all positioned in readily accessible image buffer. Printing, however, will not ensue until a pixel interrupt is developed from a timing disk 282 or 310 (FIGS. 14, 15).

Looking to FIG. 21, the compile routine is represented at label 730 leading as represented at line 732 to the procedures for collecting the message which is serially inputted to the apparatus as represented at instruction 734. From this point the message is treated, as represented by a path including line 736, node 738 and line 740, with a procedure commencing with the instruction at block 742 providing for obtaining a character from the message. When the character is identified, then as represented at line 744 and block 746, the identified character representation is multiplied by 12 for the instant embodiment to provide or point at the appropriate address in memory for the font representing the character. Such a multiplication step provides flexibility for different numbers of marker pins and the like. This factor 12 represents the number of pins at hand, i.e. six, multiplied by the number of characters to be printed by each such marker pin, i.e. two for disc 280. The routine then progresses as represented at block 750 wherein the column counter is set to zero, whereupon it will be incremented for each byte or column until the six shown in the matrix of FIG. 7 are treated. The routine then progresses as represented at line 752, node 754 and line 756 to the instructions at block 758 wherein the font byte for the column at hand is obtained from the noted character or font look-up table. For the matrix shown in FIG. 7, the first column will show pixels at two locations for the character "3". The routine then continues as represented at line 760 to the instructions at block 762 wherein the font byte so obtained from memory is positioned in the image buffer and, as represented at line 764 and block 766, the column count then is incremented to the next column or byte position. The routine then progresses as shown at line 768 to the inquiry at block 770 wherein a determination as to whether a column count equal to six is made. At such an occasion, the matrix for a single character will be completed. In the event that the count is not at the completion or sixth level, then as represented at loop line 772, the routine returns to node 754 a sufficient number of times to complete the character matrix. An affirmative result at the query of block 770 results, as represented at line 774 and block 776 in a determination as to whether the last character has been completed. In this regard, the last character will be the second for each marker pin. In the event that it has not, then as represented by loop line 778, the routine returns to node 738 to repeat the procedure obtaining a next character. In the event of an affirmative determination at block 776, then as represented at line 780 and as labelled at 782, the compile routine is concluded.

Figure 22:
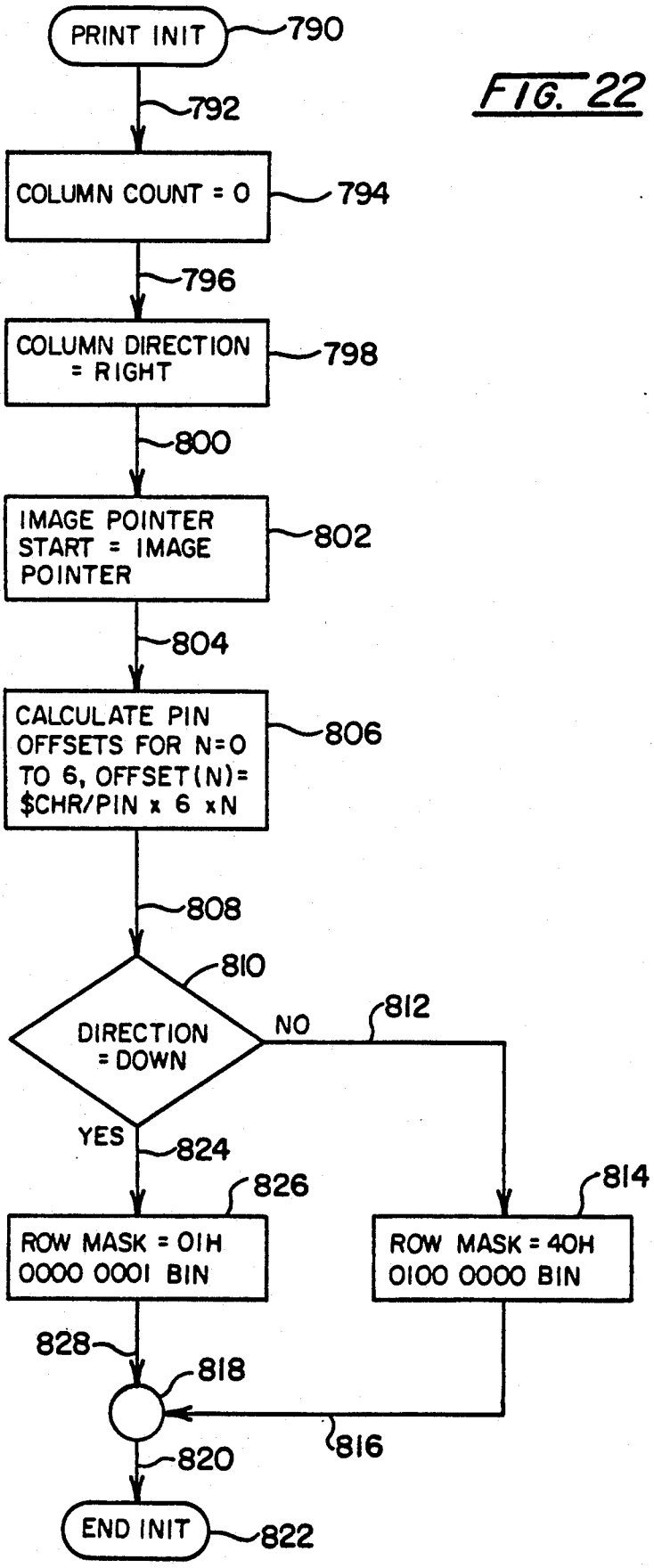
FIG. 22 is a flow diagram describing a print initiation routine employed in conjunction with the control features of the apparatus of the invention.

Referring to FIG. 22, a print initiation routine is illustrated in flow chart fashion. This routine occurs in conjunction with a command effecting the commencement of a print-out. That command may originate from a variety of sources, for example the computerized control of a robot, manual switching or the like. Generally, responses to these various forms of input are adjustable in accordance with the earlier-described switch arrays S2 and S3 as discussed in conjunction with FIG. 20A. The initiation routine is labelled at 790 and commences as represented at line 792 and block 794 to set the column count at zero. Following this procedure, as represented at line 796 and block 798, the column direction is set for movement to the right, inasmuch as under the instant protocol, carriage 112 always traverses along a row in a singular direction, for example from left to right. The routine then progresses as represented at line 800 and block 802 to establish the image pointer start as the image pointer. Then, as represented at line 804 and block 806, the routine calculates pin offsets or field lengths for the characters. In this regard, for N=0-6, where N is equal to the number of pins, the offset is made equal to the number of characters to be formed per pin multiplied by the number of columns per character cell or for example six such columns, in turn, multiplied by N or the number of pins. Upon so calculating the pin offsets, as represented at line 808 and decision block 810, a determination is made as to whether the direction is down. If the determination is in the negative, then as represented by line 812 and block 814, the row mask will be set at 40 hex representing the bottom row and the mask will mask everything with the exception of pixels within that given row. The routine then continues as represented at line 816 and node 818 and ends as represented at line 820 and node 822.

In the event the determination at block 810 is in the affirmative, then as represented at line 824 and block 826, the row mask is set a 1 hex representing the upper row and the routine then progresses as represented at line 828, node 818, line 820, and node 822.

Upon completion of the print initiation routine as described in conjunction with FIG. 22, as well as the compilation of operations described in conjunction with FIG. 21, motor assembly 268 will have been activated to drive the carriage 112 to a starting limit position and the program polls the system awaiting an input from interrupt module 294 or 296 occasioned by the movement of a respective flag or pin 302 and 304 therethrough.

Figure 23:
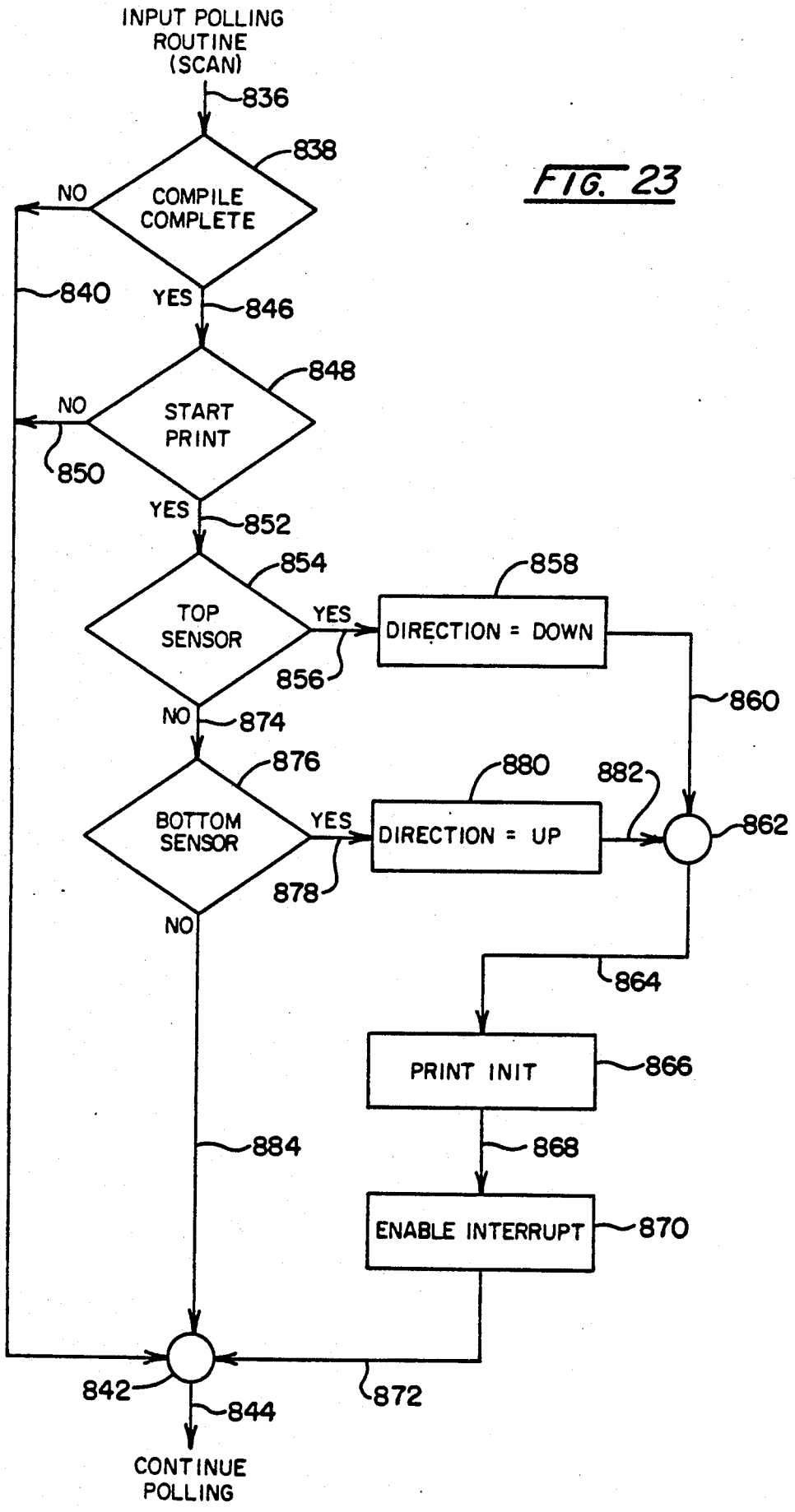
FIG. 23 is a flow diagram describing an input polling routine employed in conjunction with the control components of the apparatus of the invention.

Referring to FIG. 23, a polling routing is depicted which commences as represented at line 836 to a determination represented at block 838 as to whether the compilation procedure described in conjunction with FIG.21 is complete. In the event that it has not, then, as represented at line 840, node 842 and line 844, the routine continues to scan or poll the system. Where an affirmative determination is made at block 838, then as represented at line 846 and block 848, a determination is made as to whether a command to commence printing has been received. In the event of a negative response, then as represented at line 850, line 840, node 842, and line 844, polling continues. Where an affirmative determination is made in conjunction with the inquiry at block 848, then as represented at line 852 and block 854, a determination is made as to whether the interrupt module for the upper row has been actuated, for example, to provide a signal at line 359 (FIG. 19) occasioned by the passage of flag 302 through the gap of interrupt module 294 (FIG. 13). In the event of an affirmative response, then as represented at line 856 and block 858, a determination is made that the vertical direction of movement of the carriage 112 is downwardly from row 1 toward row 7. The program then continues as represented at line 860, node 862, and line 864 to a call for carrying out the print initiation routine as represented at block 866 and described in conjunction with FIG. 22. Following such initiation, as represented at line 868 and block 870, the interrupt function provided by timing disk 238 and associated interrupt module 284 is enabled such that the signals presented at line 366 (FIG. 19) are received as interrupts to define column pixel locations. The program then continues as represented at line 872, node 842, and line 844 to continue a polling activity.

Where the inquiry at block 854 results in a negative determination, then as represented at line 874 and block 876 a determination is made as to whether the row 7 or bottom sensor has been activated. Such activation, for example, results in a signal from interrupt module 296 represented at line 352 of the timing output circuit (FIG. 19). An affirmative determination, as represented at line 878 indicates that the direction of vertical movement of the carriage 112 is upwardly as represented at block 880. The program then continues as represented at line 882, node 862, and line 864 to carry out the print initiation routine as represented at block 866. Following this routine, as represented at line 868, and at block 870, the interrupts are enabled and as represented at line 872, node 842, and line 844, the polling routine continues. Where a negative determination is made in conjunction with the inquiry at block 876, then, as represented at line 884, node 842, and line 844, the polling routine continues.

Figure 24:
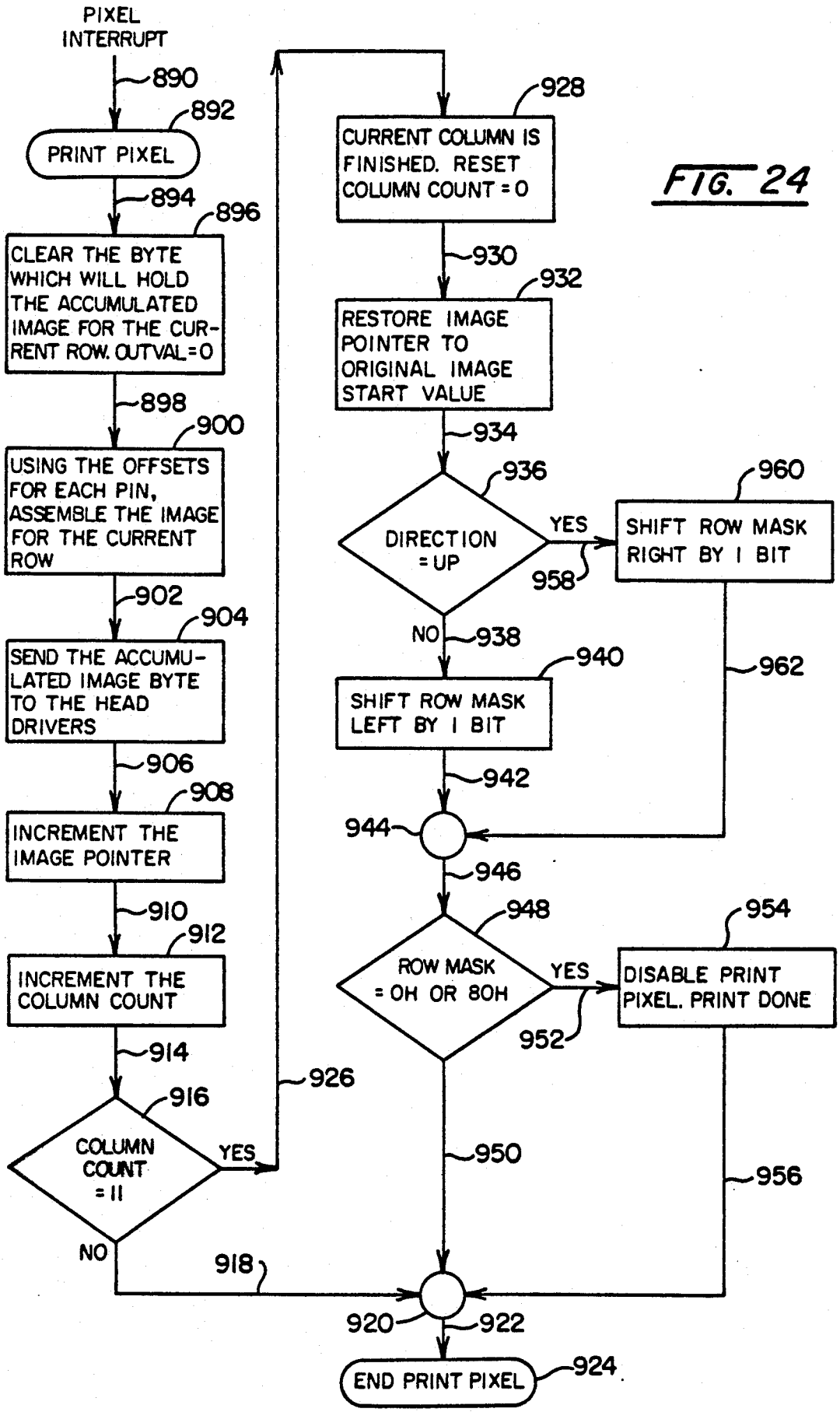
FIG. 24 is a flow diagram describing a pixel interrupt routine employed with the control features of the apparatus of the invention.

Turning to FIG. 24, a print pixel routine is illustrated. This routine occurs with each pixel interrupt as derived at line 366 (FIG. 19). An occurrence of a pixel interrupt, as represented at line 890, generates the instant routine as labeled at 892 for each array of marker pins. The routine commences as represented at line 894 and block 896 with a clearing of the byte which will hold the accumulated image for the current row of marking. As represented at line 898 and block 900, the image for the current row then is assembled employing the offsets as calculated in conjunction with the instructions at block 806 in FIG. 22. The program then continues as represented at line 902 and block 904 with instructions to send the accumulated image byte to the head drivers. These signals emanate from RIOT 432, and one such driver is described in detail in conjunction with FIG. 20C. The routine then continues as represented at line 906 and block 908 to increment the image pointer and as represented at line 910 and block 912 to increment the column count. It may be recalled from the discussion in conjunction with FIG. 7 that, for a two character designation for each marker pin, 11 such column designated interrupt signals will be developed. Accordingly, as represented at line 914 and block 916, a determination is made as to whether the column count has reached its maximum value, for example, a value of 11 as described in conjunction with FIG. 7. Where the determination is in the negative, then as represented at line 918, node 920, line 922, and label 924, the print pixel routine is ended to be subsequently called upon the occasion of the next succeeding interrupt signal. Where the determination at block 916 is in the affirmative, it then is necessary to reset the column count to zero as represented at line 926 and block 928. The routine then continues as represented at line 930 and block 932 providing for the restoring of the image pointer to its original image start value. The program then continues as represented at line 934 and block 936 to determine whether or not the direction is up. In the event that it is not, then as represented at line 938 and block 940 the row mask is shifted to the left by one bit and, as represented at line 942, node 944, and line 946, the program inquires as to whether the row mask is equal to zero hex or 80 hex as represented at block 948. In the event that it is not, then as represented at line 950, node 920, line 922, and label 924, the print pixel routine is ended. Where the inquiry at block 948 is in the affirmative, then as represented at line 952, block 954, and line 956, the printing is done and the print pixel routine is disabled, whereupon the routine ends as represented by line 956, node 920, line 922, and label 924. Where the inquiry at block 936 results in an affirmative determination, then as represented at line 958 and block 960, the row mask is shifted to the right by one bit. The routine then continues as represented at line 962 and node 944 to the earlier-described inquiry at block 948.

Since certain changes may be made in the above-described system, apparatus and method without departing from the scope of the invention herein involved, it is intended that all matter contained in the description thereof or shown in the accompanying drawings shall be interpreted as illustrative and not in a limiting sense.

We claim:

1. Apparatus for marking solid material objects at a surface thereof in response to data inputs with a sequence of indentation defined characters, each within a pixel matrix of rows and columns comprising:

a housing;

an actuator assembly mounted within said housing having a cam follower driven input and a translational mechanism including an attachment portion drivable along vertical and transverse directions from said driven input to define a substantially singular plane locus of movement of said attachment portion representing a sequence of parallel, spaced, row-defining movements each row defining movement occurring between first and second row end terminal positions, said sequence of spaced row-defining movements occurring between first and second row sequence terminal positions;

a marker head assembly coupled with said attachment portion, having a confronting portion positionable in spaced adjacency with said surface and including at least one marker pin having an impacting tip drivably movable into said surface in response to control signals;

a cam assembly mounted adjacent said actuator assembly for rotational driving association with said cam follower driver input and drivably rotatable to effect said translational mechanism drive;

a motor having a drive output for drivably rotating said cam assembly;

timing means for deriving pixel position signals corresponding with said pixels of said matrix and terminal signals corresponding with said first and second row sequence terminal positions; and control means responsive to said data inputs, said pixel position signals and said terminal signals for deriving said control signals.

2. The apparatus of claim 1 in which said translation mechanism includes:

a carrier coupled in driven relationship with said cam follower driven input and formed of two carrier component portions spaced apart to define a transverse access region reciprocally movable along said transverse direction to derive said row-defining movements; and a carriage including said attachment portion mounted upon said carrier within said transverse access region, movable therewith along said transverse direction and movable along said vertical direction to derive said singular plane locus of movement.

3. The apparatus of claim 2 in which said translation mechanism includes an isolator coupled in driven relationship with said cam follower drive input, mounted for driven movement only along said vertical direction and coupled with said carriage to impart corresponding driven movement thereto along said vertical direction.

4. The apparatus of claim 2 in which:

said actuator assembly cam follower driven input includes a transverse cam follower coupled in driving relationship with said carrier; and said cam assembly includes a transverse cam wheel mounted for driven rotation about an axis perpendicular to said singular plane and including a transverse cam track at the face thereof engageable in driving relationship with siad transverse cam follower.

5. The apparatus of claim 2 in which:

said translation mechanism includes an isolator having a vertical cam follower and mounted for driven movement along said vertical direction and coupled with said carraige to impact corresponding driven movement thereto; and said cam assembly includes a vertical cam wheel mounted for driven rotation about an axis perpendicular to said singular plane and including a vertical cam track at the face thereof engageable in driving relationship with said vertical cam follower.

6. The apparatus of claim 5 in which said isolator is located within said carrier transverse access region.

7. The apparatus of claim 2 in which each of said two spaced apart carrier component portions are generally U-shaped to provide a vertical access region and each having transversely disposed ends, said carrier components being associated by a link located at a said transversely disposed end of said two carrier components.

8. The apparatus of claim 7 in which said carrier component portions and said link are integrally formed as a unit.

9. The apparatus of claim 7 in which:

said translation mechanism includes an isolator having a vertical cam follower as a component of said actuator cam follower driven input, said isolator being mounted for driven movement along said vertical direction within said carrier transverse access region and said vertical access region, and coupled with said carriage to impart corresponding driven movement thereto;

said actuator assembly cam follower driven input includes a transverse cam follower coupled in driving relationship with said carrier at said link; and said cam assembly includes a transverse cam wheel mounted for driven rotation about an axis perpendicular to said singular plane and including a transverse cam track at the face thereof engageable in driving relationship with said transverse cam follower, said cam assembly further including a vertical cam wheel mounted for driven rotation about an axis perpendicular to said singular plane and including a vertical cam track at the face thereof engageable in driving relationship with said vertical cam follower.

10. The apparatus of claim 2 in which:

said carriage includes first shaft means fixed thereto and extending therefrom in parallel relationship with said vertical direction for supporting said carriage for said movement in said vertical direction; and said carrier includes first slidable retainer means for slidably receiving said supporting said first shaft means.

11. The apparatus of claim 10 in which said carrier includes second shaft means mounted across said housing along said transverse direction and second slidable retainer means for slidably receiving said second shaft means for supporting said carrier for said movement in said transverse direction.

12. The apparatus of claim 11 in which:

said translation mechanism includes an isolator having third shaft means mounted upon said housing along said vertical direction for supporting said isolator for movement in said vertical direction, third slidable retainer means for slidably supporting said isoaltor upon said third shaft means, fourth slidable retainer means for effecting slidable connection with said carriage; and said carriage includes fourth shaft means mounted thereon along said transverse direction for slidably receiving fourth slidable retainer means in driven relationship.

13. The apparatus of claim 1 in which said marker head assembly comprises:

a manifold connectable with said translation mechanism attachment portion and having at least one input port for receiving pneumatic drive pulses and at least one output port pneumatically communicating therewith for conveying said drive pulses;

a marker head connectable with said manifold, having said confronting portion and at least one chamber extending interiorly from an opening at said confronting portion and in pneumatic communication with a said manifold output port, said marker pin being mounted for reciprocation within said chamber, said marker pin having a drive portion and a shaft portion depending therefrom extending to said impacting tip and drivably extensible through said opening in response to said conveyed pneumatic drive pulses; and a pneumatic drive assembly coupled with said manifold port and responsive to said control signals for deriving said pneumatic drive pulses.

14. The apparatus of claim 1 in which said timing means is configured for deriving said pixel position signals in correspondence with said matrix columns only during said actuator assembly movement of said attachment portion from said first to said second row end terminal positions.

15. The apparatus of claim 14 in which said actuator assembly translation mechanism defines a said locus of movement wherein each said row-defining movement between said first and second row end terminal positions is followed by a retrace movement from said second to said first row end terminal position.

16. Apparatus for marking solid material objects at a surface thereof in response to data inputs with two lines of sequences of indentation defined characters, each within a pixel matrix of rows and columns, comprising:

a housing;

an actuator assembly mounted within said housing, having a driven input and a translation mechanism including a carriage drivable along vertical and transverse directions from said driven input to define a substantially singular plane locus of movement representing a sequence of parallel, spaced, row defining movements along said transverse direction between first and second row end terminal positions, said row defining movement spacing sequence occurring along said vertical direction between first and second row sequence terminal positions;

a manifold connectable with said carriage and having first and second arrays of input ports for receiving pneumatic drive pulses and first and second arrays of corresponding output ports in respective pneumatic communication therewith for conveying said drive pulses;

a marker head connectable with said manifold and having a confronting portion positionable in spaced adjacency with said surface and having first and second linear and parallel arrays of chambers extending interiorly from corresponding respective openings at said confronting portion and in respective and corresponding pneumatic communication with said manifold first and second arrays of output ports, each said chamber having a marker pin mounted for reciprocation therein, each said marker pin having a drive portion and a shaft portion depending therefrom extending to an impacting tip and selectively drivably extensible through a said opening of said chamber in response to a conveyed said pneumatic drive pulse;

a pneumatic drive assembly coupled with said manifold first and second arrays of input ports and responsive to control signals for deriving said pneumatic drive pulses;

drive means for effecting drive of said actuator assembly driven input;

timing means responsive to said drive means for deriving pixel position signals corresponding with said pixels of said matrix; and control means responsive to said data inputs and said pixel position signals for deriving said control signals effecting simultaneous formation of said two lines of indentation defined characters.

17. The apparatus of claim 16 in which:

said first and second arrays of output ports of said manifold are linear, arranged in parallel relationship, and spaced apart a predetermined distance;

said marker head includes an attachment portion located opposite said confronting portion and said first and second linear arrays of chambers are in mutual alignment with respective said first and second arrays of output ports; and including latch means for retaining said marker head attachment portion in abutting adjacency with said manifold.

18. The apparatus of claim 16 wherein said manifold and marker head are located exteriorly of said housing.

19. The apparatus of claim 16 in which said pneumatic drive assembly comprises:

first and second arrays of adjacently disposed solenoid actuated valves each having an intake port located at a first surface thereof and an output port for passage of said pneumatic drive pulses at a second surface thereof;

first and second arrays of flexible tubing interconnecting said output ports of respective said first and second valves with respective manifold first and second arrays of input ports; and a pneumatic chamber connectable with a supply of air under pressure in common pneumatic communication with each said intake port of said first and second arrays of valves.

20. The method for marking solid material objects at a surface thereof in response to data inputs with two spaced apart lines of sequences of indentation defined characters, each within a pixel matrix of rows and columns, comprising the steps of:

providing a housing;

providing an actuator assembly mounted within said housing and actuable to move along a locus of movement;

providing a marker head assembly connected with said actuator assembly, having a confronting portion and including two linear arrays of marker pins, said arrays of marker pins being spaced apart in correspondence with said two spaced apart lines, each said marker pin having an impacting tip extensible from said confronting portion when actuated to form said indentations in said surface;

positioning said confronting portion in spaced adjacency with said surface;

actuating said actuator assembly to effect movement of said marker head assembly along a said locus of movement wherein said confronting portion is located in a single plane substantially parallel with said surface, said movement being a sequence of parallel transverse movements between first and second row end terminal positions corresponding with each successive said row of said matrix and a sequence of movements extending between first and second row sequence terminal positions transitioning between successive adjacent said rows while retracing from said second to said first row end terminal position; and actuating said marker pins in response to said data inputs in correspondence with said matrix columns only during said head assembly movement from said first to said second row end terminal positions such that each said marker pin, when actuated, forms at least one said character of one said line.

21. The method of claim 20 wherein said step of actuating said marker pin is carried out pneumatically from a valve actuated pneumatic source located remotely from said housing.

22. Apparatus for marking solid material objects at a surface thereof in response to data inputs with a sequence of indentation defined characters, each within a pixel matrix of rows and columns comprising:

a housing;

an actuator assembly mounted within said housing having a translational mechanism including an attachment portion drivable along vertical and transverse directions to define a substantially singular plane locus of movement of said attachment portion representing a sequence of parallel, spaced, row-defining movements, each row defining movement occurring between first and second row end terminal positions, each said row defining movement being followed by a retrace movement to a next adjacent said first row end terminal position, said sequence of spaced row-defining movements occurring between first and second row sequence terminal positions;

a marker head assembly coupled with said attachment portion, having a confronting portion positionable in spaced adjacency with said surface and including at least one marker pin having an impacting tip drivably movable into said surface in response to control signals;

drive means for effecting said drive of said translational mechanism;

timing means for deriving pixel position signals corresponding with said pixels of said matrix columns only during said actuator assembly movement of said attachment portion from said first to said second row end terminal positions; and control means responsive to said data inputs, and said pixel position signals for deriving said control signals.

23. The apparatus of claim 22 in which said translation mechanism includes:

a carrier coupled in driven relationship with said cam follower driven input and formed of two carrier component portions spaced apart to define a transverse access region reciprocally movable along said transverse direction to derive said row-defining movements; and a carriage including said attachment portion mounted upon said carrier within said transverse access region, movable therewith along said transverse direction and movable along said vertical direction to derive said singular plane locus of movement.

24. The apparatus of claim 22 in which said marker head assembly comprises:

a manifold connectable with said translation mechanism attachment portion and having at least one input port for receiving pneumatic drive pulses and at least one output port pneumatically communicating therewith for conveying said drive pulses;

a marker head connectable with said manifold, having said confronting portion and at least one chamber extending interiorly from an opening at said confronting portion and in pneumatic communication with a said manifold output port, said marker pin being mounted for reciprocation within said chamber, said marker pin having a drive portion and a shaft portion depending therefrom extending to said impacting tip and drivably extensible through said opening in response to said conveyed pneumatic drive pulses; and a pneumatic drive assembly coupled with said manifold port and responsive to said control signals for deriving said pneumatic drive pulses.

25. The method for marking solid material objects at a surface thereof in response to data inputs with a sequence of indentation defining characters, each within a pixel matrix of rows and columns, comprising the steps of:

providing a housing;

providing an actuator assembly mounted within said housing and actuable to move along a locus of movement;

providing a marker head assembly connected with said actuator assembly, having a confronting portion and including a linear array of marker pins, each said marker pin having an impacting tip extensible from said confronting portion when actuated to form said indentations in said surface;

positioning said confronting portion in spaced adjacency with said surface;

actuating said actuator assembly to effect movement of said marker head assembly along a said locus of movement wherein said confronting portion is located in a single plain substantially parallel with said surface, said movement being a sequence of parallel transverse movements between first and second row end terminal positions corresponding with each successive said row of said matrix and a sequence of movements extending between first and second row sequence terminal positions transitioning between successive adjacent said rows while retracing from said second to said first row end terminal position; and actuating said marking pins in response to said data inputs in correspondence with said matrix columns only during said head assembly movement from said first to said second row end terminal positions such that each said marker pin, when actuated, forms at least one said character.

26. Apparatus for marking solid material objects at positions thereof in response to data inputs with two lines of sequences of indentation defined characters, each within a pixel matrix of rows and columns, comprising:

a housing;

an actuator assembly mounted within said housing, having a driven input and a translation mechanism including a carriage drivable along vertical and transverse directions from said driven input to define a substantially singular plane locus of movement representing a sequence of parallel, spaced, row defining movements along said transverse direction between first and second row end terminal positions, said row defining movement spacing sequence occurring along said vertical direction between first and second row sequence terminal positions;

a manifold connectable with said carriage and having first and second spaced apart arrays of input ports for receiving pneumatic drive pulses and first and second spaced apart arrays of corresponding output ports in respective pneumatic communication therewith for conveying said drive pulses;

a first marker head connectable with said manifold and having a first confronting portion positionable in spaced adjacency with said first surface portion and having a first parallel array of chambers extending interiorly from corresponding openings at said first confronting portion and in corresponding pneumatic communication with said manifold first array of output ports, each said chamber of said first array thereof having a marker pin mounted for reciprocation therein, each said marker pin having a drive portion and a shaft portion depending therefrom extending to an impacting tip and selectively drivably extensible through a said opening of said chamber in response to a conveyed said pneumatic drive pulse;

a second marker head connectable with said manifold and having a second confronting portion positionable in spaced adjacency with a second said surface portion and having a second linear and parallel array of chambers extending interiorly from corresponding openings at said second confronting portion and in corresponding pneumatic communication with said manifold second array of output ports, each said chamber of said second array thereof having a marker pin mounted for reciprocation therein, each said marker pin having a drive portion and a shaft portion depending therefrom extending to an impacting tip and selectively drivably extensible through a said opening of said chamber in response to a conveyed said pneumatic drive pulse;

a pneumatic drive assembly coupled with said manifold first and second arrays of input ports and responsive to control signals for deriving said pneumatic drive pulses;

drive means for effecting drive of said actuator assembly driven input;

timing means responsive to said drive means for deriving pixel position signals corresponding with said pixels of said matrix; and control means responsive to said data inputs and said pixel position signals for deriving said control signals effecting simultaneous formation of said two lines of indentation defined characters.

27. The apparatus of claim 26 in which:

said first and second arrays of output ports of said manifold are linear, arranged in parallel relationship, and spaced apart a predetermined distance; and said marker head includes an attachment portion located opposite said confronting portion and said first and second linear arrays of chambers are in mutual alignment with respective said first and second arrays of output ports.

28. The apparatus of claim 26 wherein said manifold and marker head are located exteriorly of said housing.

29. The apparatus of claim 26 in which said pneumatic drive assembly comprises:

first and second arrays of adjacently disposed solenoid actuated valves each having an intake port located at a first surface thereof and an output port for passage of said pneumatic drive pulses at a second surface thereof;

first and second arrays of flexible tubing interconnecting said output ports of respective said first and second valves with respective manifold first and second arrays of input ports; and a pneumatic chamber connectable with a supply of air under pressure in common pneumatic communication with each said intake port of said first and second arrays of valves.

30. Apparatus for marking solid material objects at positions thereof in response to data inputs with a sequence of indentation defined characters, each within a pixel matrix of rows and columns comprising:

a housing;

an actuator assembly mounted within said housing having a cam follower driven input and a translational mechanism including an attachment portion drivable along vertical and transverse directions from said driven input to define a substantially singular plane locus of movement of said attachment portion representing a sequence of parallel, spaced, row-defining movements each row defining movement occurring between first and second row end terminal positions, said sequence of spaced row-defining movements occurring between first and second row sequence terminal positions;

a first marker head assembly coupled with said attachment portion, having a confronting portion positionable in spaced adjacency with one said surface portion and including at least one marker pin having an impacting tip drivably movable into said surface portion in response to first control signals;

a second marker head assembly coupled with said attachment portion, having a confronting portion positionable in spaced adjacency with another said surface portion and including at least one marker pin having an impacting tip drivably movable into said other surface portion in response to second control signals;

a cam assembly mounted adjacent said actuator assembly for rotational driving association with said cam follower driver input and drivably rotatable to effect said translational mechanism drive;

a motor having a drive output for drivably rotating said cam assembly;

timing means for deriving pixel position signals corresponding with said pixels of said matrix; and control means responsive to said data inputs, and said pixel position signals for deriving said first and second control signals.

31. Apparatus for marking solid material objects at a surface thereof in response to data inputs with a sequence of identation defined characters, each within a pixel matrix of rows and columns, comprising:

a housing;

an actuator assembly mounted within said housing having a translational mechanism including an attachment portion drivable along vertical and transverse directions to define a substantially singular plane locus of movement of said attachment portion representing a sequence of parallel, spaced, row-defining movements, each row defining movement occurring between first and second row end terminal positions, each said row defining movement being followed by a retrace movement to a next adjacent said first row end terminal position, said sequence of spaced, row-defining movements occurring between first and second row sequence terminal positions;

a pneumatic distributor mounted upon said attachment portion and having an array of input ports for receiving pneumatic drive pulses and a array of corresponding output ports in respective pneumatic communication therewith for conveying said drive pulses;

a marker head connectable with said pneumatic distributor and having a confronting portion positionable in spaced adjacency with said surface and having an array of chambers extending interiorly from corresponding respective openings at said confronting portion and in respective and corresponding pneumatic communication with said pneumatic distributor array of output ports, each said chamber having a marker pin mounted for reciprocation therein, each said marker pin having a drive portion and a shaft portion depending therefrom extending to an impacting tip and selectively drivably extensible through a said opening of said chamber in response to a conveyed said pneumatic drive pulse;

drive means for effecting said drive of said translational mechanism;

a pneumatic drive assembly coupled with said pneumatic distributor array of input ports and having a plurality of adjacently disposed electromagnetically actuated valves, each having an intake port and an output port for selective passage of said pneumatic drive pulses into said pneumatic distributor input ports, and a pneumatic chamber connectible with a supply of air under pressure in common pneumatic communication with each said intake port of said valves; and control means responsive to said data input signals for actuating said valve to effect formation of said indentation defined characters.

* * * * *